US006597315B2

(12) United States Patent
Yokoshima et al.

(10) Patent No.: US 6,597,315 B2
(45) Date of Patent: Jul. 22, 2003

(54) ANTENNA

(75) Inventors: Takao Yokoshima, Tokyo (JP); Yasushige Ueoka, Tokyo (JP); Hideki Kobayashi, Kanazawa (JP); Shiro Sugimura, Kanazawa (JP); Toshiyuki Chiba, Tokyo (JP)

(73) Assignees: Mitsubishi Materials Corporation, Tokyo (JP); FEC Co., Ltd., Kanazawa (JP)

( * ) Notice: Subject to any disclaimer, the term of this patent is extended or adjusted under 35 U.S.C. 154(b) by 0 days.

(21) Appl. No.: 09/920,846

(22) Filed: Aug. 3, 2001

(65) Prior Publication Data

US 2002/0044102 A1 Apr. 18, 2002

(30) Foreign Application Priority Data

| | | |
|---|---|---|
| Aug. 4, 2000 | (JP) | P2000-237588 |
| Oct. 27, 2000 | (JP) | P2000-329558 |
| Jul. 6, 2001 | (JP) | P2001-206387 |

(51) Int. Cl.[7] ..... H01Q 1/38; H01Q 1/36

(52) U.S. Cl. ..... 343/700 MS; 343/895

(58) Field of Search ..... 343/700 MS, 702, 343/722, 873, 893, 895, 749

(56) References Cited

U.S. PATENT DOCUMENTS

| | | | | |
|---|---|---|---|---|
| 5,874,926 A | | 2/1999 | Tsuru et al. | 343/860 |
| 6,028,568 A | * | 2/2000 | Asakura et al. | 343/895 |
| 6,075,491 A | * | 6/2000 | Dakeya et al. | 343/722 |

FOREIGN PATENT DOCUMENTS

| | | | |
|---|---|---|---|
| AU | A-77 148/81 | 5/1983 | |
| GB | 2 326 529 A | 12/1998 | H01Q/7/00 |
| JP | 5-15515 | 2/1993 | H01Q/1/32 |
| JP | 5-31323 | 4/1993 | H01Q/7/08 |
| JP | 7-297627 | 11/1995 | H01Q/13/08 |
| JP | 7-321550 | 12/1995 | H01Q/23/00 |
| JP | 8-51313 | 2/1996 | H01Q/13/08 |
| JP | 8-288739 | 11/1996 | H01Q/23/00 |
| JP | 9-98009 | 4/1997 | H01Q/3/00 |
| JP | 9-153734 | 6/1997 | H01Q/13/08 |
| JP | 9-219610 | 8/1997 | H01Q/1/00 |
| JP | 10-13138 | 1/1998 | H01Q/13/08 |
| JP | 10-13139 | 1/1998 | H01Q/13/08 |
| JP | 10-32413 | 2/1998 | H01Q/1/38 |
| JP | 10-32421 | 2/1998 | H01Q/13/08 |
| JP | 10-84218 | 3/1998 | H01Q/13/08 |
| JP | 10-107537 | 4/1998 | H01Q/13/08 |
| JP | 10-209733 | 8/1998 | H01Q/1/38 |
| JP | 10-256825 | 9/1998 | H01Q/13/08 |
| JP | 11-4113 | 1/1999 | H01Q/1/38 |
| JP | 11-55022 | 2/1999 | H01Q/5/01 |
| JP | 2001-196831 | 7/2001 | H01Q/1/40 |

* cited by examiner

*Primary Examiner*—Hoang Nguyen
(74) *Attorney, Agent, or Firm*—Oblon, Spivak, McClelland, Maier & Neustadt, P.C.

(57) ABSTRACT

A high gain antenna of a compact external dimensions enables various devices for processing radio signals to include the antenna within the internal circuitry, so that there is no need to extend the antenna and avoid a danger of breaking the antenna, and the external appearance of the device is improved. The antenna is constructed by connecting antenna elements and in series, in which each antenna element has an inductance sections and a capacitance sections connected in parallel in such a way that magnetic fields generated by the inductance sections are oriented to intersect with one another so as to increase the signal gain.

18 Claims, 16 Drawing Sheets

ANTENNA

BACKGROUND OF THE INVENTION

1. Field of the Invention

The present invention relates to an antenna, suitable for inclusion in various devices having capabilities for processing radio signals, such as electrical home appliances, office equipment, wireless LAN, telemetric systems, including mobile communication devices that can transmit and receive radio signals.

2. Description of the Related Art

In recent years, there have been increasing uses for antennas that can be used in frequency bands in a range of several hundreds of MHz to several tens of GHz due to increasing demand for various devices having capabilities for transmitting and receiving radio signals, including various communication devices for processing radio signals. Obvious uses for such antennas include mobile communications, next generation traffic management systems, non-contacting type cards for automatic toll collection systems, but in addition, because of the trend toward the use of wireless data handling systems that enable to handle data without using cumbersome lengthy cables such as cordless operation of household appliances through the Internet, Intranet radio LAN, Bluetooth and the like, it is anticipated that the use of such antennas will also be widespread in similar fields. Furthermore, such antennas are used in various systems for wireless data handling from various terminals, and the demand is also increasing for applications in telemetering for monitoring information on water pipes, natural gas pipelines and other safety management systems and POS (point-of-sale) terminals in financial systems. Other applications are beginning to emerge over a wide field of commerce including household appliances such as TV that can be made portable by satellite broadcasting as well as vending machines.

To date, such antennas described above used in various devices having capabilities for receiving and transmitting radio signals are mainly monopole antennas attached to the casing of a device. Also known are helical antennas that protrude slightly to the exterior of the casing.

However, in the case of monopole antennas, it is necessary to extend the structure for each use of the device to make the operation cumbersome, and, there is a further problem that the extended portion is susceptible to breaking. Also, in the case of the helical antennas, because a hollow coil that serves as the antenna main body is embedded in a covering material such as polymer resin for protection, the size of device tends to increase if it is mounted on the outside the casing and it is difficult to avoid the problem that the aesthetics suffers. Nevertheless, reducing the size of the antenna leads only to lowering of signal gain, which inevitably leads to increasing the circuit size for processing radio signals to result in significantly higher power consumption and a need for increasing the size of the battery, and ultimately leading back to the problem that the overall size of the device cannot be reduced.

Particularly, in an attempt to increase the gain, if the antenna is constructed of a plurality of compact antenna elements grouped in a small area, it presents a problem that, when the antenna elements are placed in close proximity with one another, the overall gain cannot be raised effectively due to mutual interference of electromagnetic waves emitted from one antenna element upon its neighboring antenna elements.

To avoid mutual interference among antenna elements, it is necessary to separate the antenna elements, as in conventional arrayed antennas, ideally at a distance of more than a half wavelength of the operational frequency, or more preferably, at a distance of about several wavelengths. However, such an approach does not achieve the original objective of reducing the antenna size, at least in the MHz range of frequency bands. For this reason, there has been a need to develop a new technology for increasing the signal gain by reducing mutual interference of closely spaced antenna elements.

SUMMARY OF THE INVENTION

The present invention is provided in view of the background information described above, and an object is to provide a high gain compact antenna that reduces the overall size of a device by reducing the size of the exterior dimensions of the antenna so as to permit the antenna to be assembled into devices that process radio signals; to provide pleasing aesthetics; to eliminate the need to extend the antenna to prevent breaking, and to eliminate the need for a large sized circuit structure and battery.

Also, the present invention is provided in view of the information described above, and another object is to provide a high gain compact antenna that enables high gain to be attained by reducing the mutual interference caused by a plurality of antenna elements.

Further, the present invention is provided in view of the information described above, and another object is to provide a high gain compact antenna that enables to improve gain through a structure in which more than one antenna element are connected each other.

A first embodiment of the present invention relates to an antenna having not less than two antenna elements, wherein a plurality of antenna elements are connected in series, and each antenna element is comprised by an inductance section connected in parallel to a capacitance section.

In the present invention, an antenna element is comprised by a resonance system constituted by the inductance section and the capacitance section connected in parallel, and when more than two such antenna elements are connected in series, the assembly functions as an antenna. Compared with a case of having a singular antenna element, gain of the antenna and bandwidth can be adjusted more readily by arranging a plurality of such antenna elements. Further, the antenna is constructed by circuits having the inductance section and the capacitance section in such a way to effectively capture varying electrical and magnetic field components, so that the antenna size can be reduced by optimizing the values of the capacitance and inductance.

Also, the second embodiment of the present invention relates to the antenna in the first embodiment, wherein the plurality of antenna elements connected in series are arranged in such a way that directions of magnetic fields generated by a current flowing in each inductance section are intersecting with one another.

By adopting such a structure, the mutual interference between the antenna elements is optimized so that, compared with the case of only connecting the antenna elements in series without any care for directions of magnetic fields generated by a current flowing in each inductance section, directivity for signal reception and transmission is reduced and the gain is increased.

The present invention relates to the antenna in the first embodiment, wherein the inductance section has a coil section and a plurality of antenna elements connected in series are arranged in such a way that directions of magnetic fields generated by a current flowing in each coil section are intersecting with one another.

By adopting such a structure, the mutual interference between the antenna elements is optimized so that, compared with the case of only connecting the antenna elements in series without any care for directions of magnetic fields generated by a current flowing in each inductance section, directivity for signal reception and transmission is reduced and the gain is increased.

Also, third embodiment of the present invention relates to the antenna in the second embodiment, wherein the inductance section has a coil section comprised by a conductor formed in a spiral shape or an angular shape that can be approximated by a spiral circling a coil axis; and the plurality of antenna elements are arranged so that respective axes of adjacent coil sections are aligned on a straight line.

By adopting such a structure, the axes of the coil sections are aligned so that the size of the overall antenna is reduced, and directivity for transmitting and receiving radio waves is reduced and the gain is increased.

Further, at least one portion of portions of the conductor that circle the coil axis is contained in a plane inclined at an angle to the coil axis.

By adopting such a structure, the mutual interference between the axially-aligned adjacent antenna elements is reduced and the overall gain of the antenna is increased.

In the case of an antenna element having a coil section comprised by a conductor that circles a coil axis, there are several possible combinations of positioning each adjacent antenna element. Of the possible combinations, experiments have proven that higher gains are possible when the antenna elements are connected so that the axes of the coil sections are aligned on a straight line rather than connecting the antenna elements in parallel. In addition, the mutual interference is reduced when the adjacent antenna elements are arranged so that the coil axes are intersecting. In the present invention, priority is given to reducing the area required for mounting the antenna and also to increasing the ease of mounting.

The conductor is formed by linking the portion that circles the coil axis in the axial direction. If cylindrical coordinates are used to designate the coil axis as z-axis, and describe the position of each section of the conductor, a typical spiral exhibits monotonic changes in the z-coordinate as the angular coordinate $\theta$ is varied. Then, consider a spiral conductor that circles the coil axis over an angular displacement of $\theta$=360 degrees, and one plane intersecting the z-axis at right angles at the starting point and another plane intersecting the z-axis at the ending point of such a spiral, then this spiral does not intersect the planes except at the beginning point and at the ending point of the conductor spiral. If one supposes such a plane for each complete revolution (or turning portion) of the conductor spiral, then the conductor is divided by a series of such planes at right angles to the coil axis. When this argument is extended to a general spiral-like conductor or a conductor that can be approximated by a spiral, a group of such planes can be visualized to divide the conductor but the turning portions (loops) of the conductor do not intersect the planes except at the beginning points and the ending points of each loop. Then, each loop of the conductor can be associated with an adjacent imaginary plane using an expression "a portion of the conductor that circles the coil axis is contained in a plane" (herein below imaginary planes that divide the conductor are referred to simply as planes).

In such a case, if at least one portion of the portions that circle the coil axis is contained in a plane that is inclined at an angle to the axis, then the direction of the magnetic field generated by the current flowing in this portion tends to be perpendicular to the plane. Looking at the whole antenna, the directions of the magnetic fields generated by the current flowing in the coil sections become asymmetrical about the coil axis, so that the magnetic field generated by the current flowing in one coil section is weakened at other coil section such that the mutual interference between the antenna elements is reduced.

Also, those portions of the conductor that circle the axis may be formed so as to be parallel to each other.

By adopting such a structure, the magnetic fields generated by the current flowing in the coil sections become even more asymmetric about the axis, so that the magnetic field generated by the current flowing in one coil section is weakened at other coil section such that the mutual interference of the antenna elements is reduced. Accordingly, the gain of the overall antenna can be increased even more effectively.

Also, it is preferable that the planes in two adjacent coil sections are inclined at different angles to the coil axis.

By adopting such a structure, in the adjacent coil sections whose axes are aligned substantially on a straight line, the directions of the magnetic fields generated by the current flowing in the coil section become asymmetrical about the axis, and the magnetic field generated by the current flowing in one coil section is weakened at other coil section, and the directions of the magnetic fields generated in the two coil sections intersect one another, so that the mutual interference of the antenna elements is reduced and the gain of the overall antenna is increased.

Another embodiment of the antenna in the present invention is comprised by not less than two antenna elements connected in series, wherein each antenna element has an inductance section and a capacitance section connected electrically in parallel, and wherein a conductor section is disposed between induction sections of at least two adjacent antenna elements.

By adopting such a structure, the conductor section so provided shields the electromagnetic waves generated by the antenna elements somewhat, so that the mutual interference between the adjacent antenna elements is reduced and the gain of the antenna is increased.

A fourth embodiment of the antenna in the present invention relates to the antenna in the third embodiment, wherein the coil section is provided with a first conductor pattern formed on a first plane, a second conductor pattern formed on a second plane oppositely disposed to the first plane, and a coil conductor section for electrically connecting the first conductor pattern to the second conductor pattern; and the capacitance section has a condenser section that has a third conductor pattern formed on a third plane and a fourth conductor pattern formed on a fourth plane oppositely disposed to the third plane; such that the first plane, the second plane, the third plane and the fourth plane are disposed so as to face each other.

By adopting such a structure, the coil section and the condenser section are assembled in three-dimensions so that the area required to construct the antenna is reduced, compared with the case of arranging the coil section and the condenser section on a single substrate plate, and the antenna can be miniaturized.

In the above antenna, it is preferable that the first plane and the second plane are constituted by two opposing planes of a first substrate plate; the third plane and the fourth planes are constituted by two opposing planes of a second substrate plate; and the first substrate plate and the second substrate plate are laminated with an intervening insulation layer into an integral unit.

By adopting such a structure, the antenna is comprised by two substrate plates with an intervening insulation layer so that the handling is facilitated.

Also, in the antenna in the first embodiment of the present invention, the plurality of antenna elements are connected in series to a frequency adjusting capacitance section.

By adopting such a structure, the resonant frequency (it may also be referred to sometimes as the center frequency in the description) at which the antenna resonates with a maximum gain can be altered.

It is preferable that the plurality of antenna elements are contained in an antenna main body, and the frequency adjusting capacitance section is provided as a separate body from the antenna main body such that the antenna main body and the frequency adjusting capacitance section comprise an antenna module.

By adopting such a structure, the capacitance of the frequency adjusting capacitance section is provided in another component body so that the resonant frequency can be adjusted independently of the antenna main body. That is, once the antenna main body is formed to suit a particular frequency, subsequent adjusting of frequency is carried out by adjusting the capacitance of the frequency adjusting capacitance section provided as a separate body from the antenna main body. Such an antenna module comprised by an antenna main body and a separate frequency adjusting capacitance section, enables flexible frequency adjustment.

Also, in the antenna according to the first embodiment, the plurality of antenna elements and an electrode one connected electrically to the antenna elements are provided in the antenna main body; and the antenna main body is mounted on a substrate plate having an electrode two so as to form a frequency adjusting capacitance section between the electrode one and the electrode two.

In the present invention, an electrode one provided on the antenna main body operates in conjunction with an electrode two provided on a substrate plate mounted with the antenna, for example, the grounding plate for the printed board mounted with the antenna, to form the frequency adjusting capacitance section. By adopting such a structure, it is possible to adjust the capacitance of the frequency adjusting capacitance section by altering the area of the electrode two provided on the substrate plate, for example, or by adjusting the position of the substrate plate on which the antenna is mounted. More specifically, the capacitance value of the frequency adjusting capacitance section can be adjusted when mounting the antenna on the substrate plate, by adjusting the size of the area opposing the grounding plate on the printed board, for example. When assembling the antenna into a product, a shift in the antenna frequency caused by the effect of casing and the like can be corrected by adjusting the mounting position of the antenna so as to change the capacitance of the frequency adjusting capacitance section. Or, it is also possible to deliberately change the frequency of the antenna by a large amount.

Also, in the antenna in the fourth embodiment, the plurality of antenna elements and an electrode one formed on a fifth plane that opposes the first to fourth planes inclusively are contained in an antenna main body; and the antenna main body is mounted on a substrate plate having an electrode two so as to form a frequency adjusting capacitance section between the electrode one and the electrode two.

In the present invention, the electrode one provided on the antenna main body operates in conjunction with the electrode two provided on a substrate plate mounted with the antenna, for example, the grounding plate of the printed board mounted with the antenna, to form the frequency adjusting capacitance section. By adopting such a structure, it is possible to adjust the capacitance of the frequency adjusting capacitance section by altering the area of the electrode two provided on the substrate plate, for example, or by adjusting the position of the substrate plate on which the antenna is mounted. More specifically, the capacitance value of the frequency adjusting capacitance section can be adjusted when mounting the antenna on the substrate plate, for example, by adjusting the size of the area opposing the grounding plate of the printed board. When assembling the antenna into a product, a shift in the antenna frequency caused by the effect of casing and the like can be corrected by adjusting the mounting position of the antenna so as to change the capacitance of the frequency adjusting capacitance section. Or, it is also possible to deliberately change the frequency of the antenna by a large amount.

Also, the plurality of antenna elements and the frequency adjusting capacitance section are connected in three-dimensions so that the antenna does not occupy a large space when it is incorporated into a device to enable to miniaturize the device.

It is preferable in the above case that the first plane and the second plane are constituted by two opposing planes of a first substrate plate; the third plane and the fourth planes are constituted by two opposing planes of a second substrate plate; the fifth plane is constituted by a plane of a frequency adjusting substrate plate; and the first substrate plate, the second substrate plate and the frequency adjusting substrate plate are laminated with respective intervening insulation layers into an integral unit.

By adopting such a structure, the antenna may be mounted as an integral unit on a substrate plate to facilitate handling.

Also, the present invention relates to the antenna in the first embodiment, wherein the inductance section has a coil section comprised by a conductor formed in a spiral shape or an angular shape that can be approximated by a spiral circling a coil axis; and a plurality of antenna elements are arranged so that respective axes of adjacent coil sections are aligned on a straight line.

By adopting such a structure, the axes of the coil sections are aligned so that the size of the overall antenna is reduced, and directivity for transmitting and receiving radio waves is reduced and the gain is increased.

Further, at least one portion of portions of the conductor that circle the coil axis is contained in a plane inclined at an angle to the coil axis.

By adopting such a structure, the mutual interference between the axially-aligned adjacent antenna elements is reduced and the overall gain of the antenna is increased.

Also, it is preferable that the planes in two adjacent coil sections are inclined at different angles to the coil axis.

By adopting such a structure, the mutual interference of the antenna elements is reduced more effectively and the gain of the overall antenna is increased.

The overall effect of the antenna according to the present invention are summarized below.

According to the present invention, because a inductance section and a capacitance section are connected in parallel in each antenna element, and plurality of such antenna elements are connected in series, the gain is increased, and also, unlike the monopole antennas or helical antennas, the size of the antenna can be reduced because the antenna is constructed of solid-state circuit elements. Accordingly because the antenna can be incorporated into various devices for processing radio signals, there is no need for antenna to be extended manually so that the danger of breaking is eliminated and the overall appearance of the device is enhanced.

Also, according to the present invention, because the plurality of antenna elements are arranged so that the directions of the magnetic fields generated by the current flowing in the inductance sections are intersecting, directivity of signal radiation becomes more homogeneous when processing radio signals, compared with the case of simply arranging the antenna elements in series, and the gain can be increased.

Also, according to the present invention, because the inductance section has a coil section, the value of inductance can be increased, and, because the plurality of antenna elements are arranged so that the magnetic fields generated by the coil sections are intersecting, directivity for signal radiation can be reduced when processing radio signals comperd with the case of simply arranging the antenna elements in series, and the gain can be increased.

Also, according to the present invention, because the inductance section has a coil section, the value of inductance can be significantly increased compared with the case of having simple line conductors and the like, and because the adjacent antenna elements are arranged so that the coil axes of the coil sections are aligned in a straight line, the overall size of the antenna can be made smaller and directivity for signal reception can become more homogeneous and the gain can be increased.

Also, according to the present invention, because the coil sections in the adjacent antenna elements are aligned substantially on a straight line, and the portions (turning section) that circle the coil axis are contained in associated planes that are oriented at an angle to the coil axis, the mutual interference between the antenna elements is reduced to enable to construct a high gain compact antenna.

Also, according to the present invention, because the portions that circle the coil axis are contained in associated planes that are oriented at an angle to the coil axis and are arranged in parallel to each other, the mutual interference between the antenna elements are further reduced to enable to construct a high gain compact antenna.

Also, according to the present invention, because the planes that substantially contain the portions that circle the coil axis of the conductor are oriented at different angles in the coil sections of adjacent coil sections, the mutual interference between the antenna elements is reduced to enable to construct a high gain compact antenna.

Also, according to the present invention, because a conductor section is disposed between the adjacent antenna elements, the mutual interference between the antenna elements is reduced to enable to construct a high gain compact antenna.

Also, according to the present invention, because the coil section and the condenser section are constructed of a lamination in which the first to fourth conductor patterns inclusively oppose respective planes in a three-dimensional structure so that, compared with the case of arranging the coil section and the condenser section on a single piece of substrate plate, the antenna is contained in a smaller space. Thus, the antenna is miniaturized to facilitate its incorporation inside the device for processing radio signals.

Also, according to the present invention, a unitized antenna can be assembled into a device for processing radio signals so that its handling is facilitated.

Also, according to the present invention, because a frequency adjusting capacitance section is connected to the antenna, a frequency at which a maximum gain is achieved can be varied and altered.

Also, according to the present invention, because the plurality of antenna elements are contained in an antenna main body, and the frequency adjusting capacitance section is provided as a separate body from the antenna main body such that the antenna main body and the frequency adjusting capacitance section comprise an antenna module, so that after the antenna main body is formed to suit a particular frequency, subsequent adjusting of frequency can be carried out by adjusting the capacitance of the frequency adjusting capacitance section provided as a separate body from the antenna main body to enable to perform frequency adjustment operation flexibly.

Also, according to the present invention, because the plurality of antenna elements and an electrode one connected electrically to the antenna elements are provided in the antenna main body; and the antenna main body is mounted on a substrate plate having an electrode two so as to form a frequency adjusting capacitance section between the electrode one and the electrode two, it is possible to adjust the capacitance of the frequency adjusting capacitance section by altering the area of the electrode two provided on the substrate plate, or by adjusting the position of the antenna to the substrate plate by mounting. When assembling the antenna into a product, a shift in the antenna frequency caused by the effect of casing and the like can be corrected by adjusting the mounting position of the antenna so as to change the capacitance of the frequency adjusting capacitance section. Or, it is also possible to deliberately change the frequency of the antenna by a large amount.

Also, according to the present invention, because the plurality of antenna elements and an electrode one formed on a fifth plane that opposes the first to fourth planes inclusively are contained in an antenna main body; and the antenna main body is mounted on a substrate plate having an electrode two in such a way to form a frequency adjusting capacitance section between the electrode one and the electrode two, it is possible to adjust the capacitance of the frequency adjusting capacitance section by altering the area of the electrode two provided on the substrate plate, or by adjusting the position of the antenna to the substrate plate by mounting. When assembling the antenna into a product, a shift in the antenna frequency caused by the effect of casing and the like can be corrected by adjusting the mounting position of the antenna so as to change the capacitance of the frequency adjusting capacitance section. Or, it is also possible to deliberately change the frequency of the antenna by a large amount. Further, the plurality of antenna elements and the frequency adjusting capacitance section are connected in three-dimensions so that the antenna does not occupy a large space when it is incorporated into a device to enable to miniaturize the device.

Also, according to the present invention, because the first plane and the second plane are constituted by two opposing planes of a first substrate plate; and the third plane and the fourth planes are constituted by two opposing planes of a second substrate plate; and the fifth plane is constituted by a plane of a frequency adjusting substrate plate; and the first substrate plate, the second substrate plate and the frequency adjusting substrate plate are laminated with respective intervening insulation layers into an integral unit, the antenna is made as one unit and handling is facilitated when mounting the antenna on a substrate plate.

DESCRIPTION OF THE PREFERRED EMBODIMENTS

In the following, preferred embodiments of the present invention will be explained with reference to the drawings.

Figure 2:
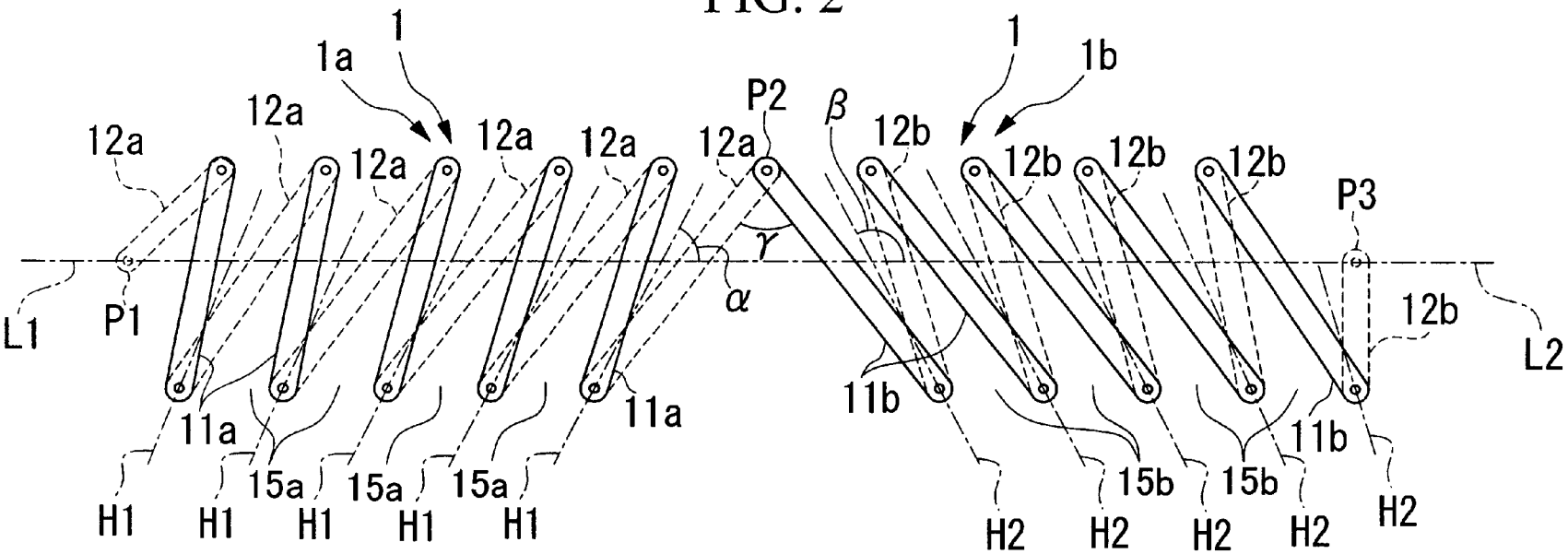
FIG. 2 is a top view of the example of the antenna in Embodiment 1 of the present invention.
Figure 3:
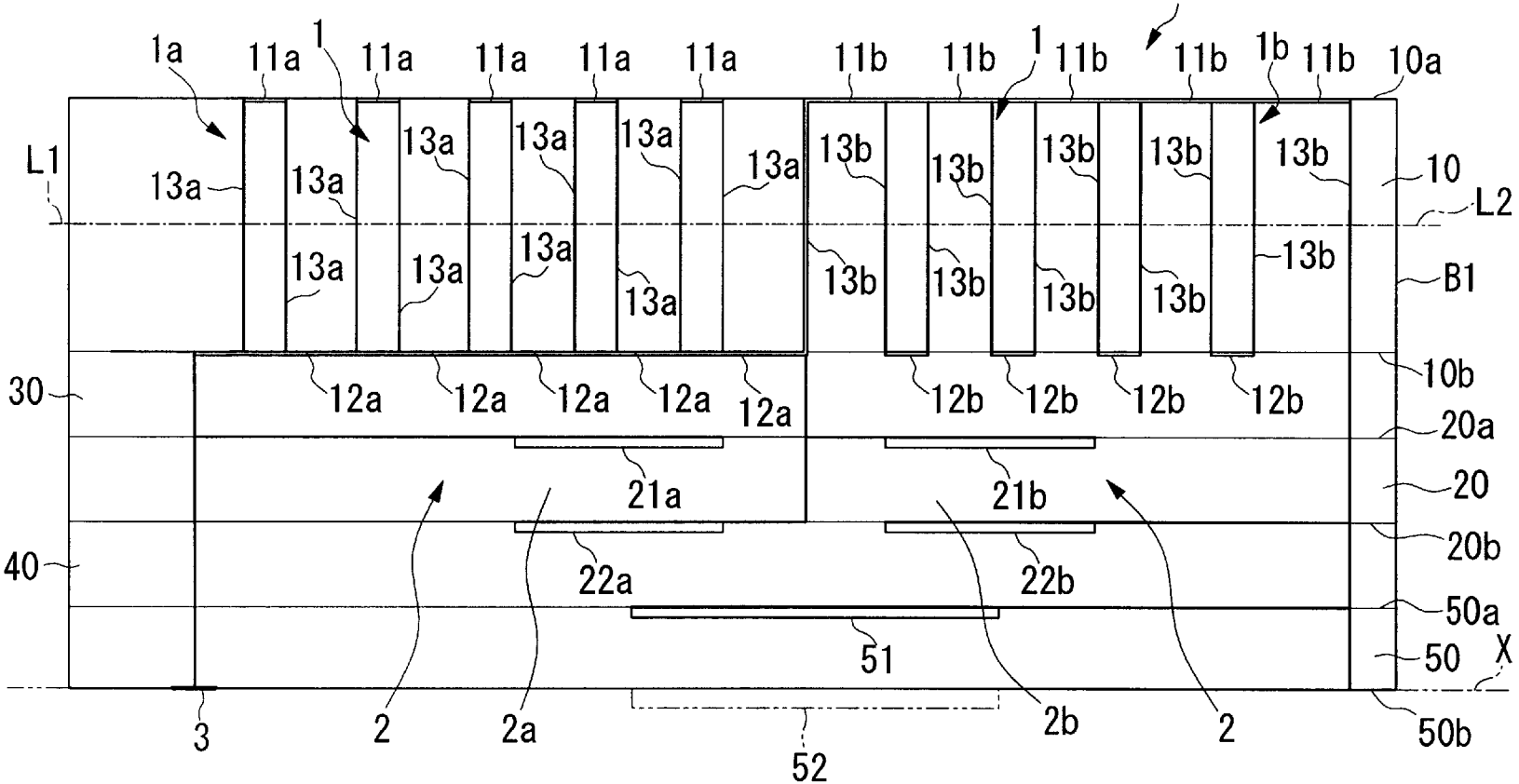
FIG. 3 is a schematic diagram showing the laminated structure of the antenna in Embodiment 1 of the present invention.
Figure 4:
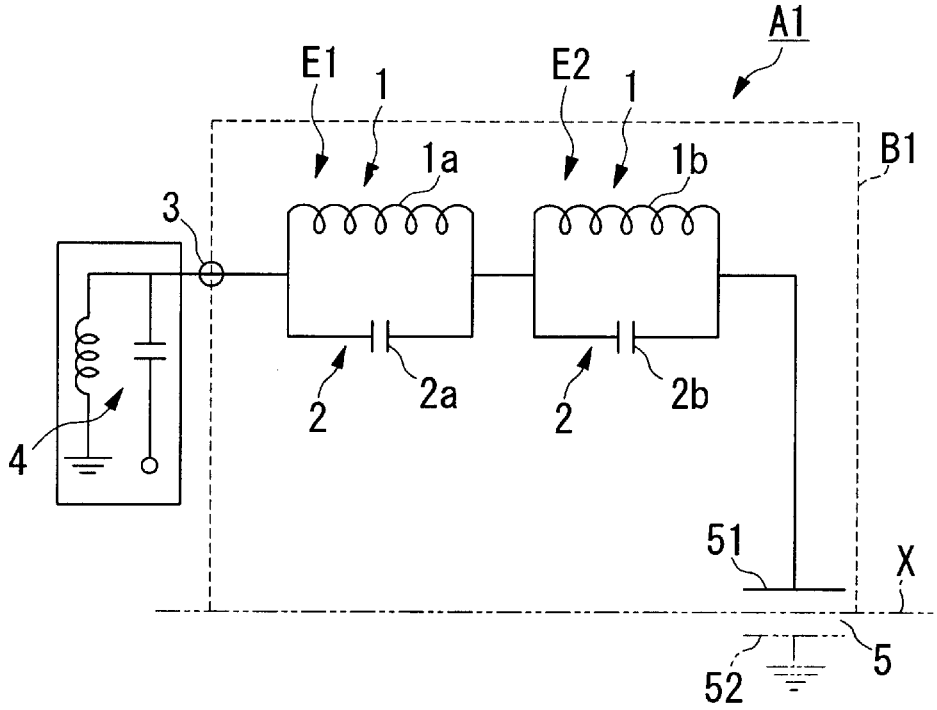
FIG. 4 is an equivalent circuit diagram of the antenna in Embodiment 1 of the present invention.

FIGS. 1~4 show the antennas in Embodiment 1 of the present invention. In the diagrams, antenna A1 has two antenna elements E1, E2, and these antenna elements E1, E2 are electrically connected electrically in series. The antenna elements E1, E2 are comprised respectively by having an inductance section 1 and a capacitance section 2 that are connected in parallel. FIG. 4 shows an equivalent circuit of these connections.

A junction point P1, which is a terminal belonging to the antenna E1 and represents the end that is not connected to the antenna E2, is connected to the feed point 3 from which power is supplied to the antenna elements E1, E2. An impedance matching section 4 is connected as mathing circuit externally to the feed point 3 to match the input impedance of the antenna A1 (refer to FIG. 4).

Further, a junction point P3, which is a terminal belonging to the antenna E2 and represents the end that is not connected to the antenna E1, is connected electrically in series to a frequency adjusting capacitance section 5, and other terminal of the frequency adjusting capacitance section 5 is grounded (refer to FIG. 4).

Each inductance section 1 has a respective coil section 1*a* or 1*b*.

The coil section 1*a* is comprised by a conductor body resembling a square shaped spiral circling about a coil axis L1, and, as shown in FIG. 3, this conductor body has conductor patterns 11*a* (first conductor patterns) and conductor patterns 12*a* (second conductor patterns), made of silver and having dimensions of 5 mm length, 0.5 mm width and 0.01 mm thickness, formed respectively on a plane 10*a* (first plane) and a plane 10*b* (second plane) that are oriented parallel to the substrate plate 10 (first substrate plate); and coil conductor section 13*a* of 1.5 mm length for electrically connecting the conductor patterns 11*a* and 12*a* by means of metal conductor filled in through-holes punched through the substrate plate 10 in the thickness direction.

The coil section 1*b* is comprised by a conductor body resembling a square shaped spiral circling about a coil axis L2, and this conductor body has conductor patterns 11*b* (first conductor patterns) and conductor patterns 12*b* (second conductor patterns), made of silver and having dimensions of 5 mm length, 0.5 mm width and 0.01 mm thickness, formed respectively on a plane 10*a* (first plane) and a plane 10*b* (second plane) that are oriented parallel to the substrate plate 10 (first substrate plate); and coil conductor section 13*b* of 1.5 mm length for electrically connecting the conductor patterns 11*a* and 12*a* by means of metal conductor filled in through-holes punched through the substrate plate 10 in the thickness direction.

The conductor body comprising the coil sections 1*a*, 1*b* is constructed so as to spiral for a number of turns (five turns in this embodiment) in the same direction (clockwise direction in this embodiment) about the coil axes L1, L2.

The coil sections 1*a*, 1*b* are connected so that they are substantially collinear through the junction point P2, and the external dimensions of the antenna A1 are 26 mm in total length and width of about 5 mm. Here, the inductance value of the inductance section 1 in this embodiment is 250 nH at 460 MHz.

Figure 1:
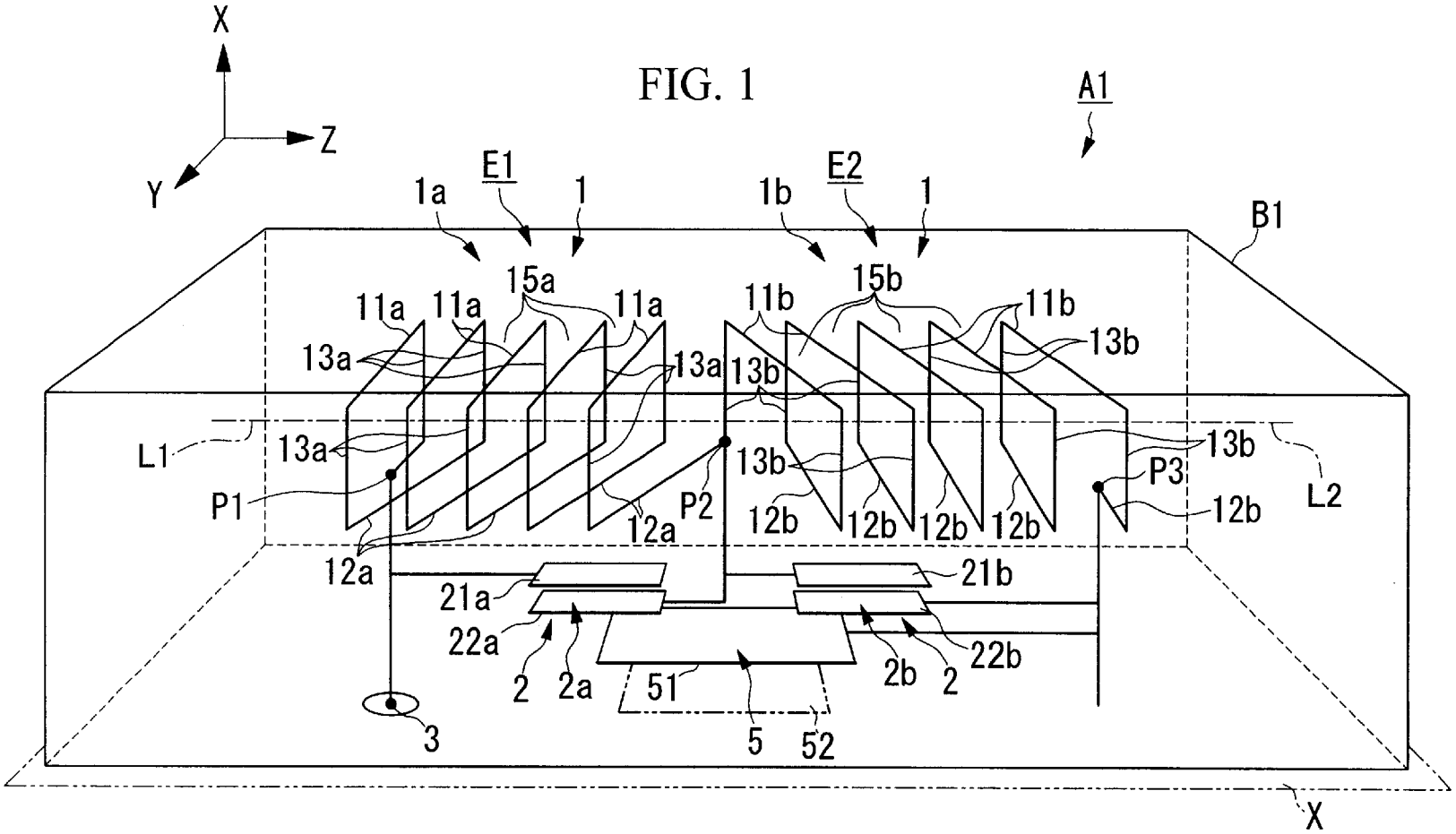
FIG. 1 is a perspective view of an example of an antenna in Embodiment 1 of the present invention.

FIG. 2 is a top view of the antenna shown in FIG. 1, and represents an enlarged view of the coil sections 1*a*, 1*b* seen vertically in the direction of the axes L1, L2. As shown in FIG. 2, the conductor patterns 11*a* and conductor patterns 12*a* of the antenna element E1 and the conductor patterns lib and conductor patterns 12*b* of the antenna element E2 are formed in such a way that their orientation angles with respect to the axes L1, L2 are different. That is, the adjacent coils 1*a*, 1*b* are oriented so that the mean angle between the axis L1 and the conductor patterns 11*a*, 12*a* of the antenna element E1 is $\alpha$, while the mean angle between the axis L2 and the conductor patterns 11*b*, 12*b* of the antenna element E2 is $\beta$, so that the angles $\alpha$ and $\beta$ are different for the antenna elements E1 and E2. Furthermore, these angles $\alpha$ and $\beta$ are selected angles other than 90 degrees.

More specifically, the coil section 1*a* is constructed in such a way that the conductor is formed so that the turning section 15*a* (the portion that circles the axis once) that circles the axis L1, in the order of conductor pattern 12*a*, coil conductor section 13*a*, conductor pattern 11*a* and the coil conductor section 13*a*, is linked in the direction of the axis L1, such that the angle $\alpha$ referred here relates to an average angle that the turning section 15*a* makes with the axis L1 when viewed from above. Similarly, the coil section 1*b* is comprised in such a way that the conductor is formed so that the turning section 15*b* that circles the axis L2 once in the order of conductor pattern 12*b*, coil conductor section 13*b*, conductor pattern 11*b* and the coil conductor section 13*b*, is linked in the direction of the axis L2, such that the angle β referred here relates to an average angle that the turning section 15*b* makes with the axis L2 when viewed from above.

The conductor of the coil section 1*a* is inclined at an angle α and is divisible by planes H1 that are oriented at right angles to the plane of the paper of FIG. 2 and are inclined at an angle to the axis L1, and the turning sections 15*a* are made in such a way that the turning sections 15*a* do not intersect the planes H1 except at the start point and the end point. In this situation, the turning sections 15*a* may be said to be included substantially in the planes H1. Also, since the conductor patterns 11*a* and the conductor pattern 12*a* are formed parallel to each other, the turning sections 15*a* are formed parallel to each other.

Similarly, the conductor body of the coil section 1*b* is inclined at an angle β and is divisible by planes H2 that are oriented at right angles to the plane of the paper of FIG. 2 and are inclined at an angle to the axis L2, and the turning sections 15*b* are made in such a way that the turning sections 15*b* do not intersect the planes H1, H2 except at the start point and the end point. In this context, the turning sections 15*b* may be said to be included in the planes H2. Also, since the conductor patterns 11*b* and the conductor pattern 12*b* are formed parallel to each other, the turning sections 15*b* are formed parallel to each other.

Further, the conductor pattern 12*a* of the coil section 1*a* of the antenna element E1 and the conductor pattern 11*b* of the coil section 1*b* of the antenna element E2 form an angle between about 90 degrees and roughly an acute angle γ at the junction point P2 when viewed from above, as shown in FIG. 2. Accordingly, the coil sections 1*a*, 1*b* are constructed so that they are wound at different angles of inclination. The result is that, in each coil sections 1*a*, 1*b*, the directions of the magnetic fields produced by the flowing current in the respective coil sections 1*a*, 1*b* intersect at an angle in the vicinity of the junction point P2.

The capacitance sections 2 has a respective condenser section 2*a* or 2*b*.

The condenser sections 2*a*, 2*b* are comprised by respective conductor patterns 21*a*, 21*b* and conductor patterns 22*a*, 22*b* having a roughly square shape of 0.01 mm thickness and made of silver, and are formed respectively on a plane 20*a* (third plane) and a plane 20*b* (fourth plane) that are oriented parallel to the substrate plate 20 (second substrate plate) that has the same length and width dimensions as the first substrate plate 10, so that conductor patterns 21*a*, 21*b* and conductor patterns 22*a*, 22*b* are placed in opposition. And, one conductor pattern 21*a* of the antenna element E1 is connected electrically to the feed point 3 while the other conductor pattern 22*a* is connected electrically to the junction point P2. Also, one conductor pattern 21*b* of the antenna element E2 is connected electrically to the junction point P2 while the other conductor pattern 22*b* is connected electrically to the junction point P3. The capacitance value of the capacitance section 2 in this embodiment is 80 pF at 400 MHz.

Here, the substrate plate 10 and substrate plate 20 are laminated as a unit with a middle layer, which is a substrate plate 30 (insulation layer) comprised primarily of alumina.

The impedance matching section 4, for matching the input impedance of the antenna A1 connected to the feed point 3, is shown as an equivalent circuit in FIG. 4.

Also, an electrode 51 (electrode one) is electrically connected to the junction point P3. The electrode 51 is comprised of silver of 0.01 mm thickness, and is formed on top of a surface 50*a* (fifth plane) of a substrate plate 50 (frequency adjusting substrate plate) having the same length and width dimensions as the substrates 10, 20. The substrate plate 50 is disposed so that the electrode 51 faces the inductance sections 1 and the capacitance sections 2, and is stacked in parallel to the substrate plate 20 so as to clamp the substrate plate 40 comprised primarily of alumina serving as the insulation layer. In this way, the antenna main body B1 is comprised by laminating the substrate plates 10, 20 and 30 having the antenna elements E1, E2 formed therein, and further laminating the substrates plates 40 and 50 on the laminated body.

The antenna A1 is constructed so that, by mounting the antenna main body B1 on a printed board X, the frequency adjusting capacitance section 5 connected in series electrically with the antenna element E2 is formed between the electrode 51 and the electrode 52 (electrode two) formed on the printed board X. That is, the antenna main body B1 is mounted on the printed board X so that the electrode 51 and the electrode 52 are opposite to each other and that the capacitance value is determined by the area of the electrodes 51, 52 or the distance between the electrode plates and the nature of the in-between material. And, by grounding the electrode 52, the other end of the frequency adjusting capacitance section 5 is grounded.

The antenna A1 according to this embodiment is formed so that an antenna element having the inductance section 1 connected in parallel with the capacitance section 2 serves as a resonance section, and two such antenna elements are connected electrically in series to serve as a resonance system, so that the entire assembly as a whole provides a function of transmitting and receiving radio waves. Compared with a case of using only one antenna element, by arranging not less than two antenna elements as described above, it is possible to adjust the signal gain. Because the antenna contains a circuit having an inductance section 1 and a capacitance section 2 so as to capture varying magnetic field components and electric field components of radio waves, the antenna can be made more compact by optimizing the values of the capacitance and inductance.

Here, it should be noted that there are many more possible combinations of positional relationship of adjacent antenna elements E1, E2 than those shown in this embodiment. However, it has been proven experimentally that higher gains are produced by connecting the antenna elements E1, E2 so that the axes L1, L2 are arranged substantially on a straight line rather than connecting the coil sections 1*a*, 1*b* in parallel.

In addition, it is known that mutual interference is decreased by arranging the antenna elements E1, E2 so that the axes L1, L2 are intersecting, for example. However, in this embodiment, the structure of aligning the axes L1, L2 is adopted so as to lower the area required for mounting and to increase the convenience for mounting the device.

Also, as demonstrated in this embodiment, mutual interference between the antenna elements E1, E2 is optimized by winding the coil sections 1*a*, 1*b* of the antenna elements E1, E2 differently so that the magnetic fields produced by the current flowing in the coil sections 1*a*, 1*b* are intersecting, thus reducing the directivity for signal transmission and reception and increasing the signal gain, compared with the design based on a simple linear arrangement of coils without giving difference for windings.

That is, the coil sections 1*a*, 1*b* are constructed in such a way that in the adjacent coil sections 1*a*, 1*b* having the axes L1, L2 arranged approximately collinearly, the turning section 15*a* and the turning section 15*b*, that constitute conductor bodies of the respective coil sections 1*a*, 1*b*, are oriented with respect to the axes L1, L2 at respective angles α and β on average, which are different than 90 degrees, so that the directions of the magnetic fields generated by the current flowing in the coil sections 1*a*, 1*b* become nearly perpendicular to the inclined planes H1, H2 containing the turning sections 15*a*, 15*b* especially at the end of the coil sections 1*a*, 1*b*, and become asymmetrical about the axes L1, L2. Therefore, the strength of the magnetic field produced in the coil section 1*b* by the current flowing in the coil section 1*a* become weaker, and the strength of the magnetic field produced in the coil section 1*a* by the current flowing in the coil section 1*b* become weaker, thereby reducing the mutual interference between the coil sections 1*a*, 1*b*. Further, angles α and β are made different and the conductor pattern 12*a* on the coil section 1*a* of the antenna element E1 and the conductor pattern 11*b* on the coil section 1*b* of the antenna element E2 are oriented at an angle γ of about 90 degrees in the top view, so that the magnetic fields produced by the current flowing in the coil sections 1*a*, 1*b* intersect at an angle close to 90 degrees in the region near the junction point P2, thus reducing the mutual interference between the antenna elements E1, E2 and increasing the overall gain of the antenna A1.

Further, by laminating the substrate plate 10, substrate plate 20 and substrate plate 50, the circuits in the coil sections 1*a*, 1*b*, condenser sections 2*a*, 2*b*, and frequency adjusting capacitance section 5 are assembled in three-dimensions, so that, compared with the case of assembling the circuit on one substrate plate, the amount of area required becomes less, thus enabling to reduce the size of the antenna. Also, by integrating the substrates 10, 20 and 50 with respective insulation layers 30, 40 in one unit in an antenna main body B1, handling is simplified.

In addition, depending on the value of the capacitance of the frequency adjusting capacitance section 5, the resonant frequency of the antenna A1 is altered so as to adjust the frequency that provides the maximum gain.

Also, by the action of the impedance matching section 4, the impedance in the transmission path from the high frequency power source of the high frequency circuit connecting to the feed point 3 and the input impedance of the antenna A1 are matched, thereby enabling to minimize the transmission loss.

As described above, according to this embodiment, because the axes L1, L2 of the coil sections 1*a*, 1*b* of the antenna elements E1, E2 are arranged substantially collinearly, and the turning sections 15*a*, 15*b* of the coil sections 1*a*, 1*b* are contained within the planes H1, H2 that are oriented at an angle to the axes L1, L2, and because the antenna elements E1, E2 are arranged in series so that the directions of the magnetic fields in the inductance sections 1 will intersect one another, uniform radiation patterns can be obtained, and furthermore, the mutual interference between the antenna elements El, E2 is reduced and the gain is increased.

Figure 5:
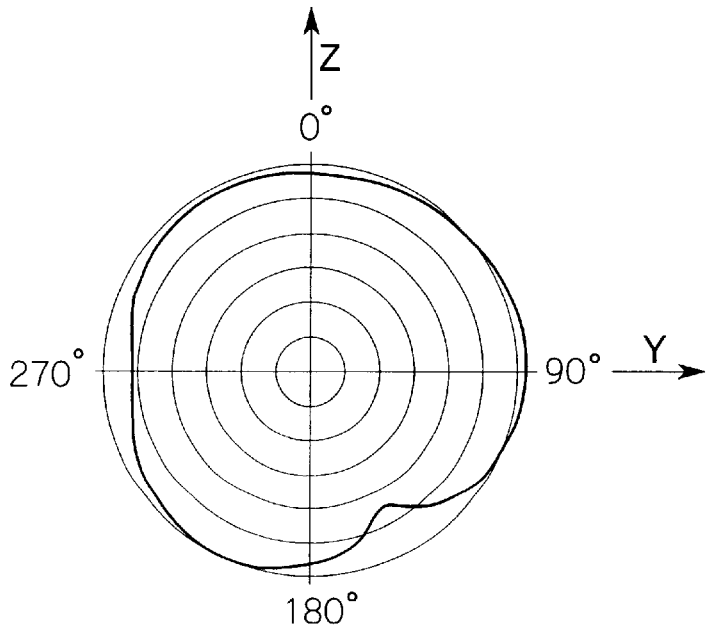
FIG. 5 is a diagram showing a radiation pattern of an antenna of the present invention.

For example, FIG. 5 shows the directivity of the antenna elements E1, E2 according to this embodiment for transmitting and receiving the radio wave in terms of a power pattern within the Y-Z plane. The graph shows that there is no significant directionality in the power pattern, and the pattern is roughly uniform in all directions. The absolute gain obtained was 2.16 $dB_i$ at the frequency of 460 MHz. Accordingly, because of the high gain, there is no need to use large circuit and battery, and the device can be made compact.

Figure 6:
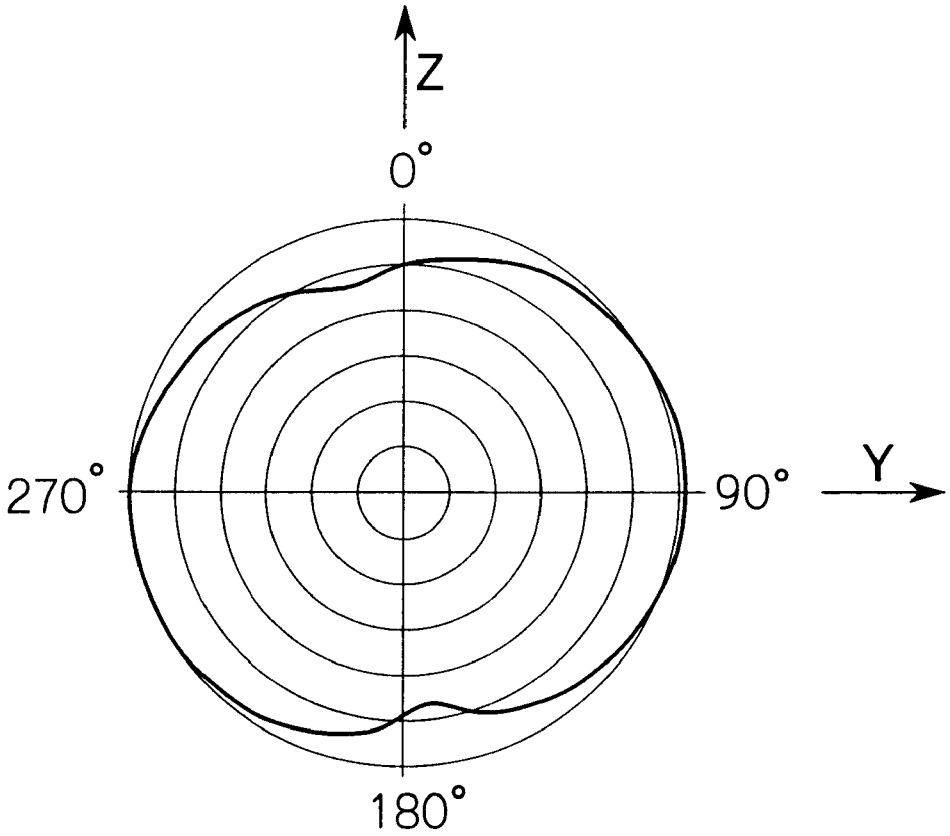
FIG. 6 is a diagram showing a radiation pattern of an antenna of the present invention.

Also, for example, FIG. 6 shows a radiation pattern within the Y-Z plane in terms of the power distribution from the antenna elements E1, E2, whose inductance in the inductance section 1 is 69 nH at 1 MHz and the capacitance in the capacitance section 2 is 30 pF at 1 MHz. The maximum gain obtained was 1.63 $dB_i$ at 478 MHz. When the angles α and β were both set to 90 degrees, the maximum absolute gain was reduced by 0.5 $dB_i$ to produce a value of 1.12 $dB_i$. It is clear from these results that the antenna according to the present invention increase the gain.

Also, because the conductor pattern 12*a* of the antenna element E1 and the conductor pattern 11*b* of the antenna element E2 intersect at an angle γ of 90 degrees at the junction point P2, corresponding exactly to horizontally polarized waves and vertically polarized waves, it is possible to obtain a uniform radiation pattern. FIGS. 5 and 6 show that such antennas exhibit non-directivity for radiation of radio signals.

In these cases, the gain shown in FIGS. 5 and 6 was obtained by preparing a copper-clad glass epoxy substrate plate of 300 mm square, and removing the copper cladding from a corner to form an insulation region of 50×150 mm, and placing an antenna A1 having external dimensions of 26 mm length and 5 mm width and 2 mm thickness on the corner. A high frequency input cable was attached to the feed point side through the impedance matching section 4 to give a matching impedance of 50 Ω, and one end of the frequency adjusting capacitance section 5 on the terminating side was grounded through a 10 mm length conductor wire attached to the copper cladding on the substrate plate.

According to this embodiment, because the antenna is comprised by circuitry so that, unlike the monopole or helical antennas, the antenna can be miniaturized by optimizing the capacitances and inductances. And, because the antenna can be incorporated in the interior of various devices for transmitting and receiving radio signals, the need to physically extend the antenna is eliminated as well as the danger of breaking is eliminated and the overall appearance is improved.

Especially, because the inductance section 1, capacitance section 2 and the frequency adjusting capacitance section 5 are provided in one unit by laminating the substrate plates 10, 20 and 50, the antenna A1 can be formed within a small three-dimensional space to provide even more convenience of handling.

Further, when the antenna main body B1 is mounted on the printed board X, the capacitance of the frequency adjusting capacitance section 5 can be adjusted by varying the installation location or by other means, so as to enable to adjust and alter the frequency of the antenna A1 flexibly.

The frequency adjusting capacitance section 5 may be provided separately from the antenna main body B1 so as to facilitate adjustment of the capacitance. For example, it is possible to design so that the frequency adjusting substrate plate 50 is not provided integrally with the substrates 10~30 but is provided as an external condenser connected electrically in series. Further, an antenna module may be constructed such that it is comprised by an antenna main body and an externally-connected condenser section serving the function of the frequency adjusting capacitance section so that the antenna main body and the condenser section may be detached so that various condensers having different capacitance values may be switched easily. Such a design further improves its handling by facilitating exchange of condenser sections. Such a construction enables to adjust the resonance frequency of the antenna more flexibly.

Figure 7:
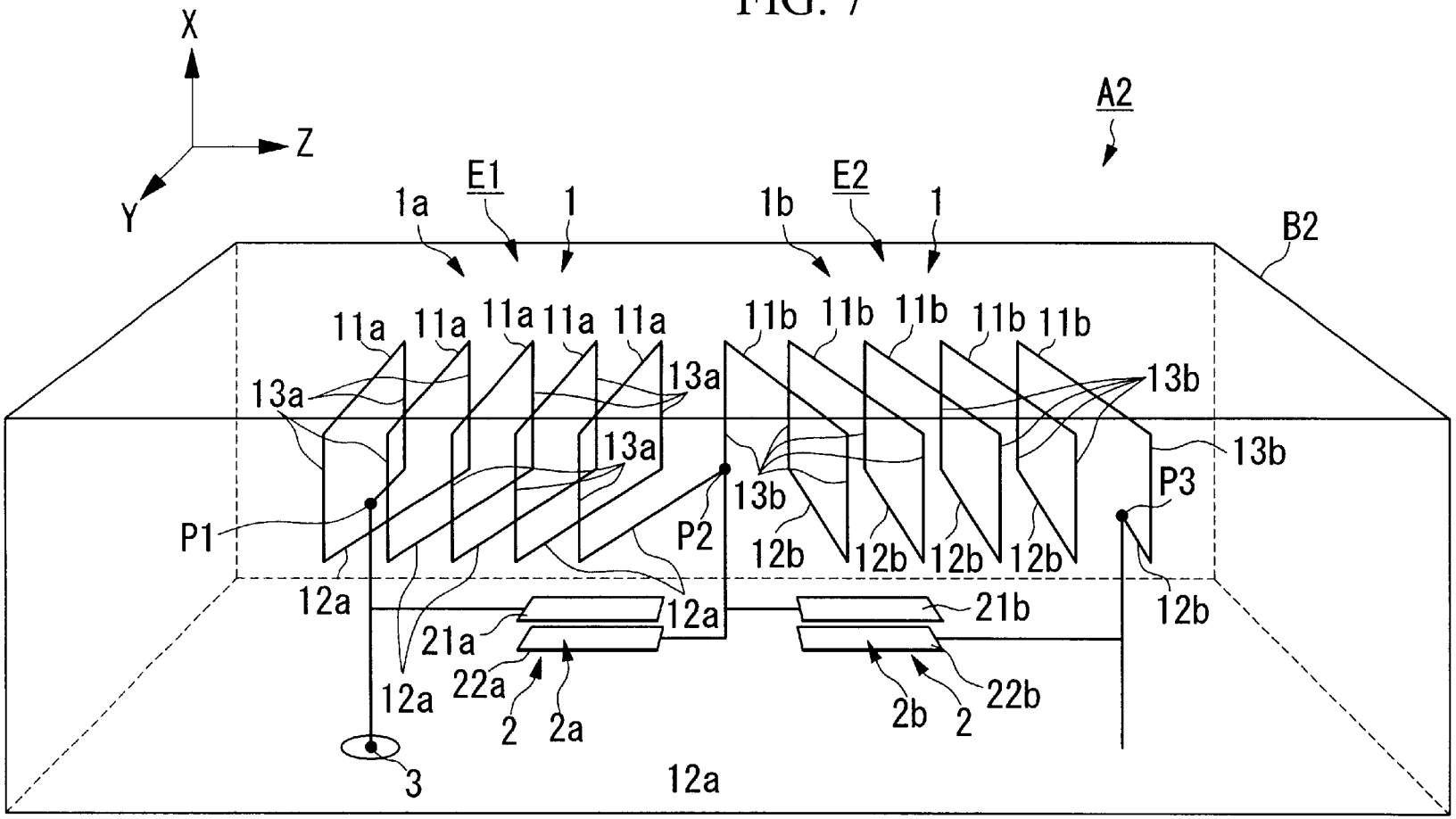
FIG. 7 is a perspective view of another example of the antenna in Embodiment 1 of the present invention.
Figure 8:
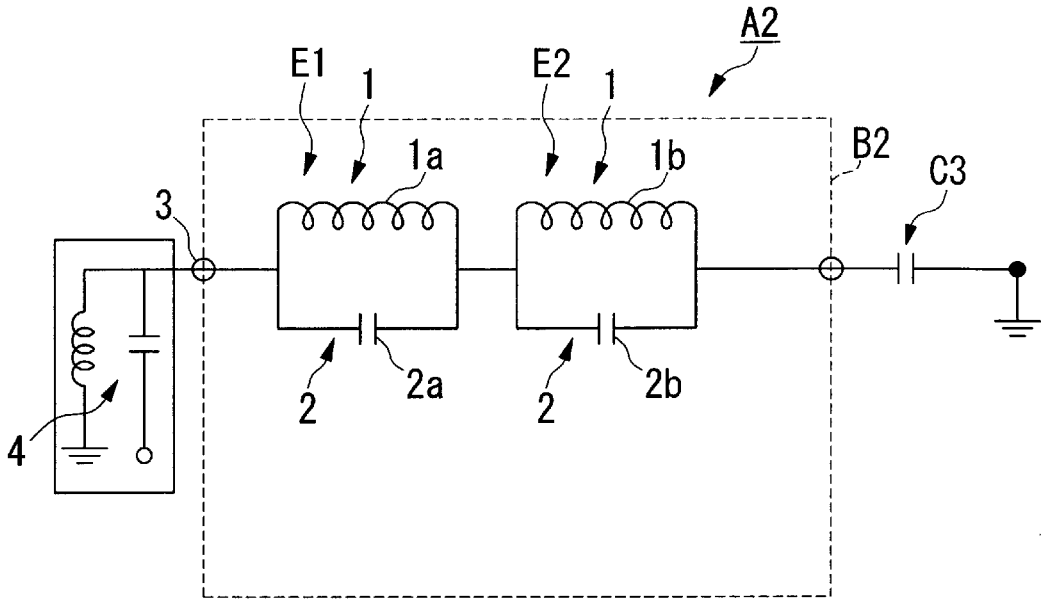
FIG. 8 is an equivalent circuit diagram of the antenna shown in FIG. 7.

The antenna A2 shown in FIGS. 7 and 8 is comprised primarily of an antenna main body B2, and the frequency adjusting capacitance section C3 for adjusting the center frequency of the antenna A2 is provided separately from the antenna main body B2 and is connected electrically in series externally to the antenna main body B2.

Table 1 shows center frequencies of the antenna A2 for different values of the capacitance of the frequency adjusting capacitance section C3 and the corresponding values of maximum gain.

TABLE 1

| Capacitance of C3 (pF) | Center Frequency (MHz) | Maximum gain ($dB_i$) |
|---|---|---|
| 1.1 | 553 | 0.54 |
| 1.5 | 513 | 2.80 |
| 3.0 | 428 | 2.42 |
| 3.5 | 380 | 2.95 |

Here, the gain was obtained by preparing a copper-clad glass epoxy substrate plate of 300 mm square, and removing the copper cladding from a corner to form an insulation region of 50×150 mm, and placing an antenna A2 having external dimensions of 26 mm length and 5 mm width and 2 mm thickness on the corner. A high frequency input cable was attached to the feed point side through the impedance matching section 4 to give a matching impedance of 50 Ω, and the other end of the antenna A2 was grounded through a 10 mm length conductor wire which is attached to the copper cladding on the substrate plate and the frequency adjusting capacitance section 5 is amounted in.

As shown in Table 1, it can be understood that the center frequency can be varied in a range of 380~510 MHz by changing the values of the capacitance of the frequency adjusting capacitance section C3. Depending on the condition, it can be also useful to work the antenna at the frequency of 553 MHz, although the gain is lower than at the other frequencies.

Figure 9:
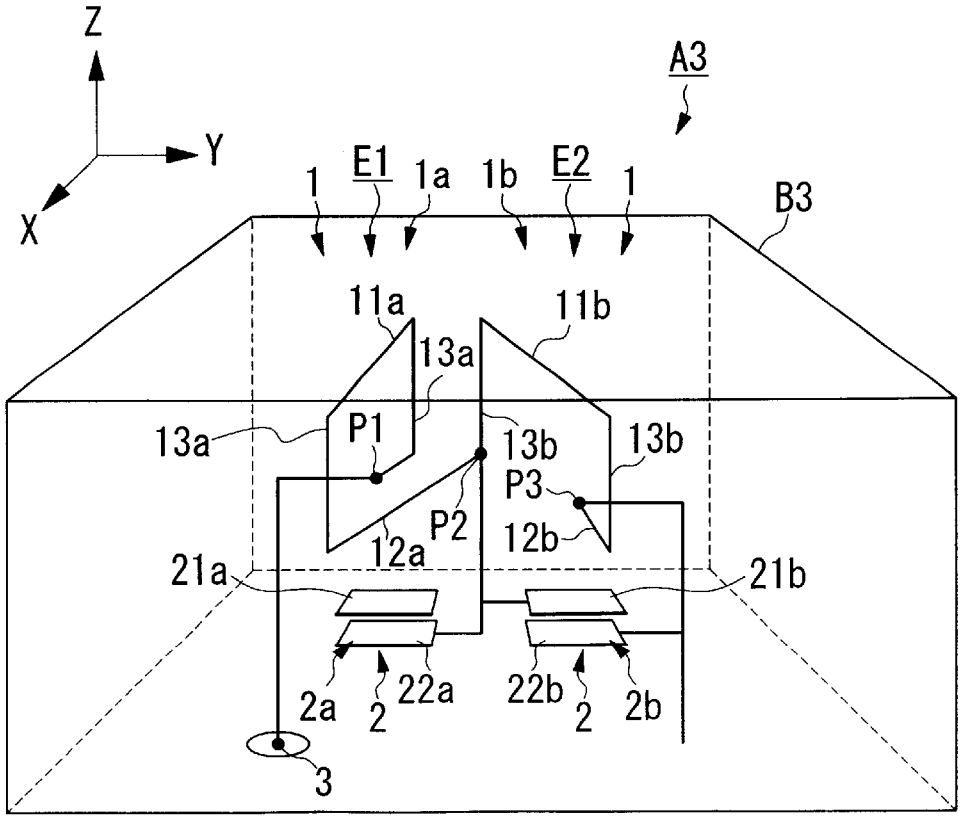
FIG. 9 is a perspective view of an example of an antenna in Embodiment 2 of the present invention.
Figure 10:
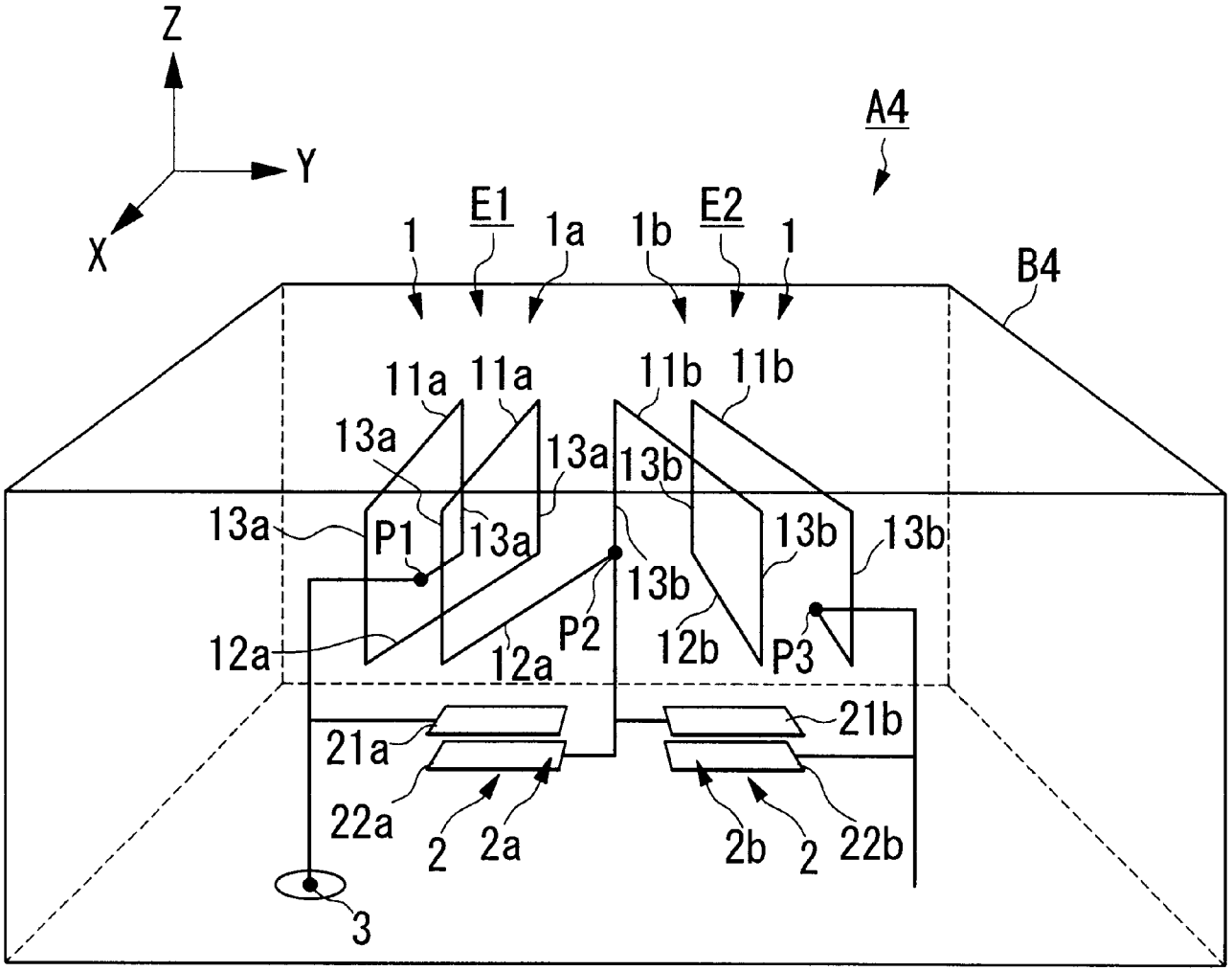
FIG. 10 is a perspective view of another example of the antenna in Embodiment 2 of the present invention.
Figure 11:
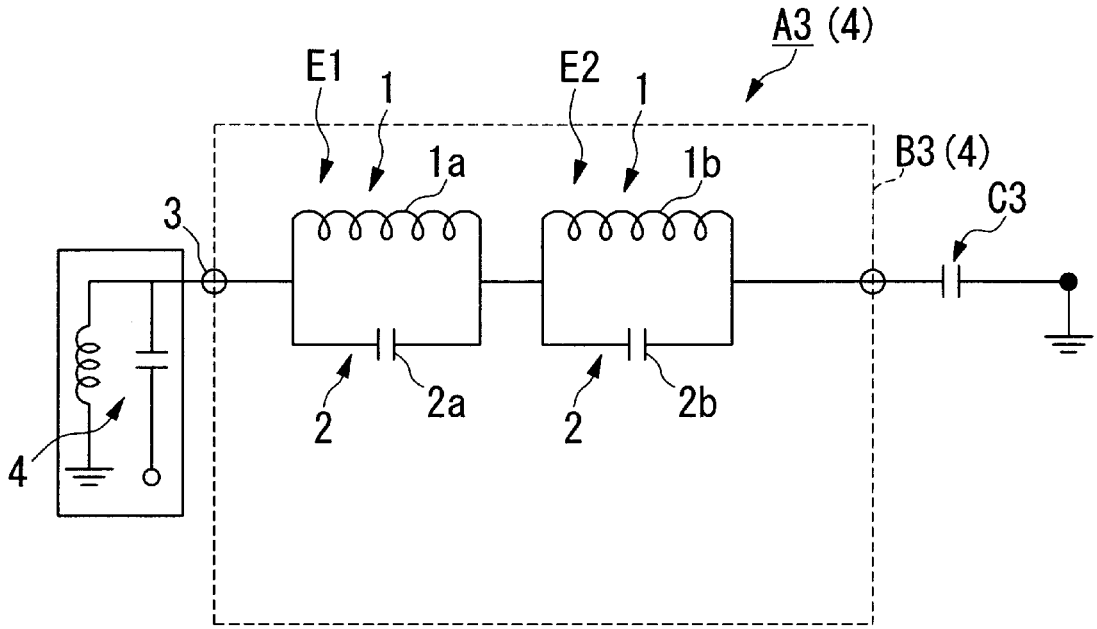
FIG. 11 is an equivalent circuit diagram of the antennas shown in FIGS. 9 and 10 with a frequency adjusting capacitance section for frequency adjustment.
Figure 18:
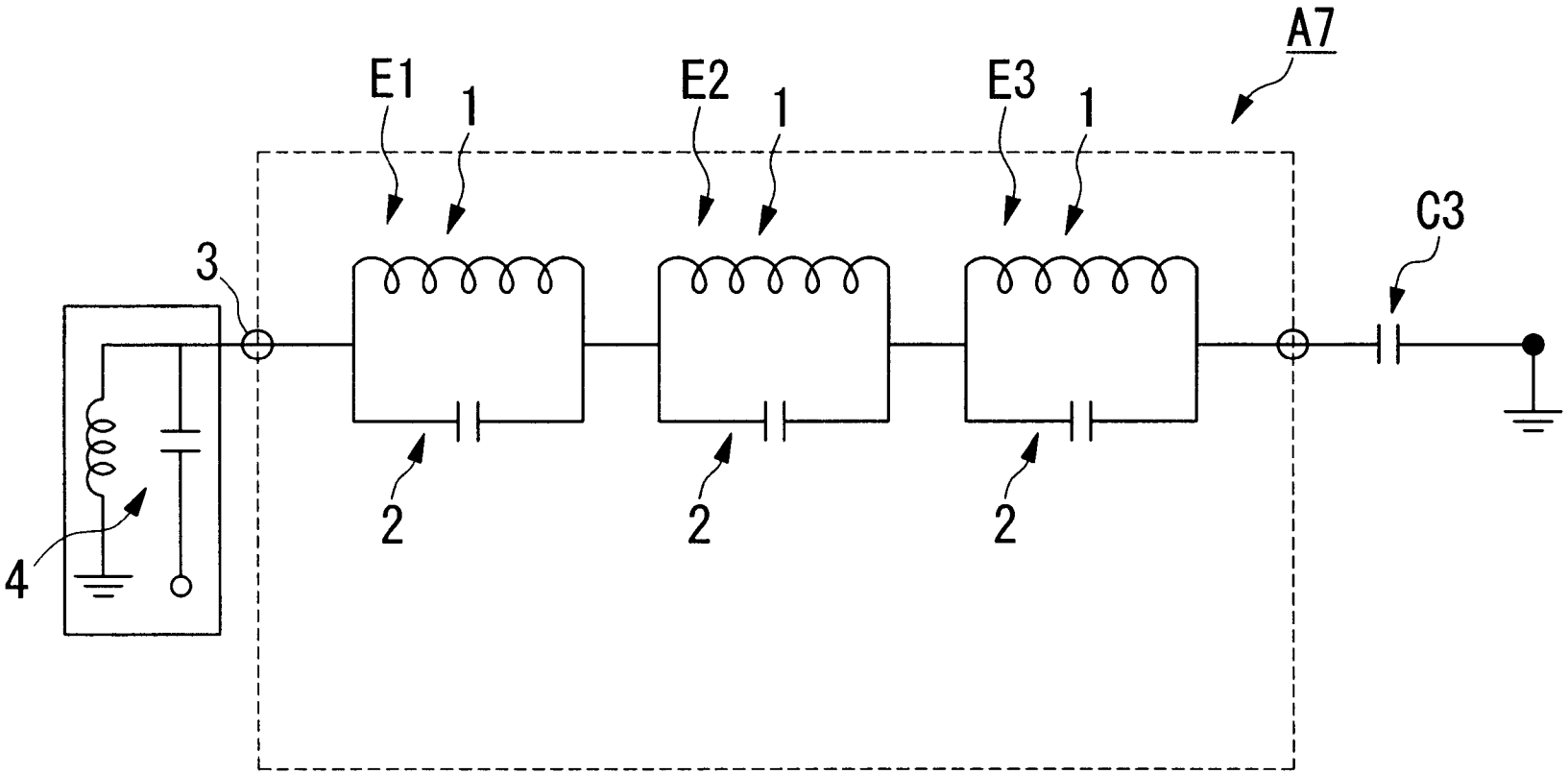
FIG. 18 is an equivalent circuit diagram of an antenna in another embodiment.

Also, according to the embodiment described above, five turns are provided in each coil, but the number of windings may be varied. FIGS. 9~11 show Embodiment 2 of the antennas of the present invention. The antennas shown in these diagrams are constructed with different number of windings. In these drawings, those parts that correspond to the parts shown in FIGS. 18 are referred to by the same reference numbers, and their explanations are omitted.

The antenna A3 shown in FIG. 9 is constructed so as to operate with the center frequency in GHz range, and the inductance sections 1 are comprised of coil sections 1*a*, 1*b*, each section having one turn of coil to lower the inductance. Such an antenna A3, operating at 100 MHz for example, has an inductance of 4.2 nH in each of the inductance sections 1, and a capacitance of 16 pF in each of the capacitance sections 2. When the external dimensions of the antenna A3 are 7 mm overall length, 3 mm width and 1 mm thickness, the antenna A3 produced the center frequency of 2.356 GHz and the maximum gain of 0.98 $dB_i$.

Here, the gain was obtained by preparing a copper-clad TEFRON® substrate plate of 52×30 mm, and removing the copper cladding from a corner to form an insulation region of 10×30 mm, and placing an antenna A3. A high frequency input cable was attached to the feed point side through the impedance matching section 4 to give a matching impedance of 50 Ω, and the other end of the antenna A3 was grounded through a 5 mm length conductor wire which serves as a capacitance refered to as C3 in FIG. 11.

Further, as shown in FIG. 10, the inductance sections 1 of the antenna A4, operating at 100 MHz for example, may be comprised of coil section 1*a*, 1*b* that have two turns in each coil. Such an antenna A4 has an inductance of 8.0 nH in each of the inductance sections 1, and a capacitance of 10 pF in each of the capacitance sections 2*a*, 2*b*. When the external dimensions of the antenna A4 are 7 mm overall length, 3 mm width and 1 mm thickness, the antenna A4 produced the center frequency of 2.346 GHz and the maximum gain of 0.84 $dB_i$.

Here, the gain was obtained by preparing a copper-clad TEFRON® substrate plate of 52×30 mm, and removing the copper cladding from a corner to form an insulation region of 10×30 mm, and placing an antenna A4. A high frequency input cable was attached to the feed point side through the impedance matching section 4 to give a matching impedance of 50 Ω, and the other end of the antenna A4 was grounded through a 5 mm length conductor wire which serves as a capacitance refered to as C3 in FIG. 11.

The antennas A3 and A4 shown in FIGS. 9 and 10 are provided with a frequency adjusting capacitance section separately for adjusting the center frequency of the respective antennas, as shown in FIG. 11, so that it may be connected externly and electrically in series to the antenna main bodies B3 and B4. By connecting a frequency adjusting capacitance section C3 having a capacitance value of up to 0.2 pF, the center frequency may be shifted up to about 200 MHz.

Figure 12:
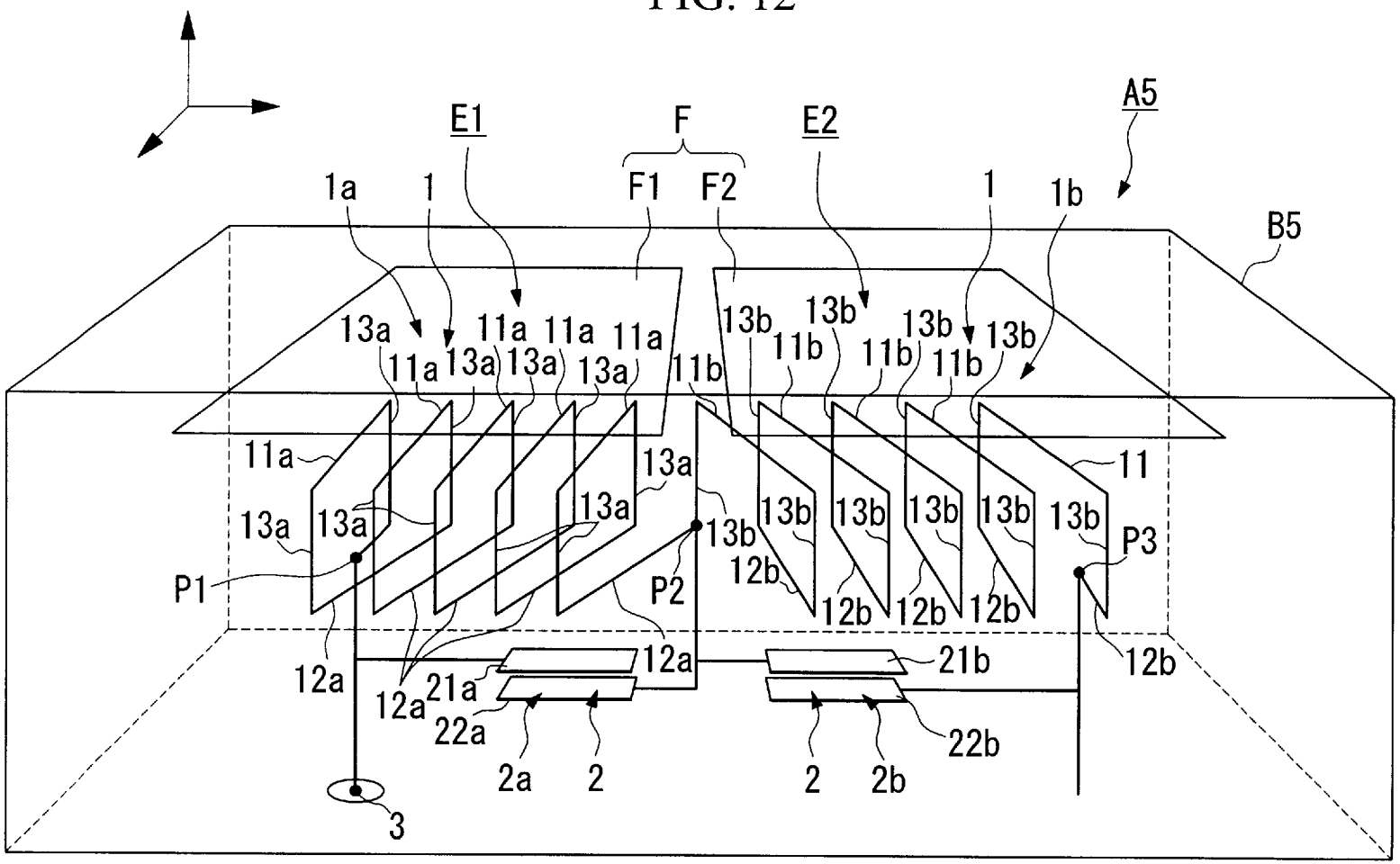
FIG. 12 is a perspective view of an example of an antenna in Embodiment 3 of the present invention.
Figure 13:
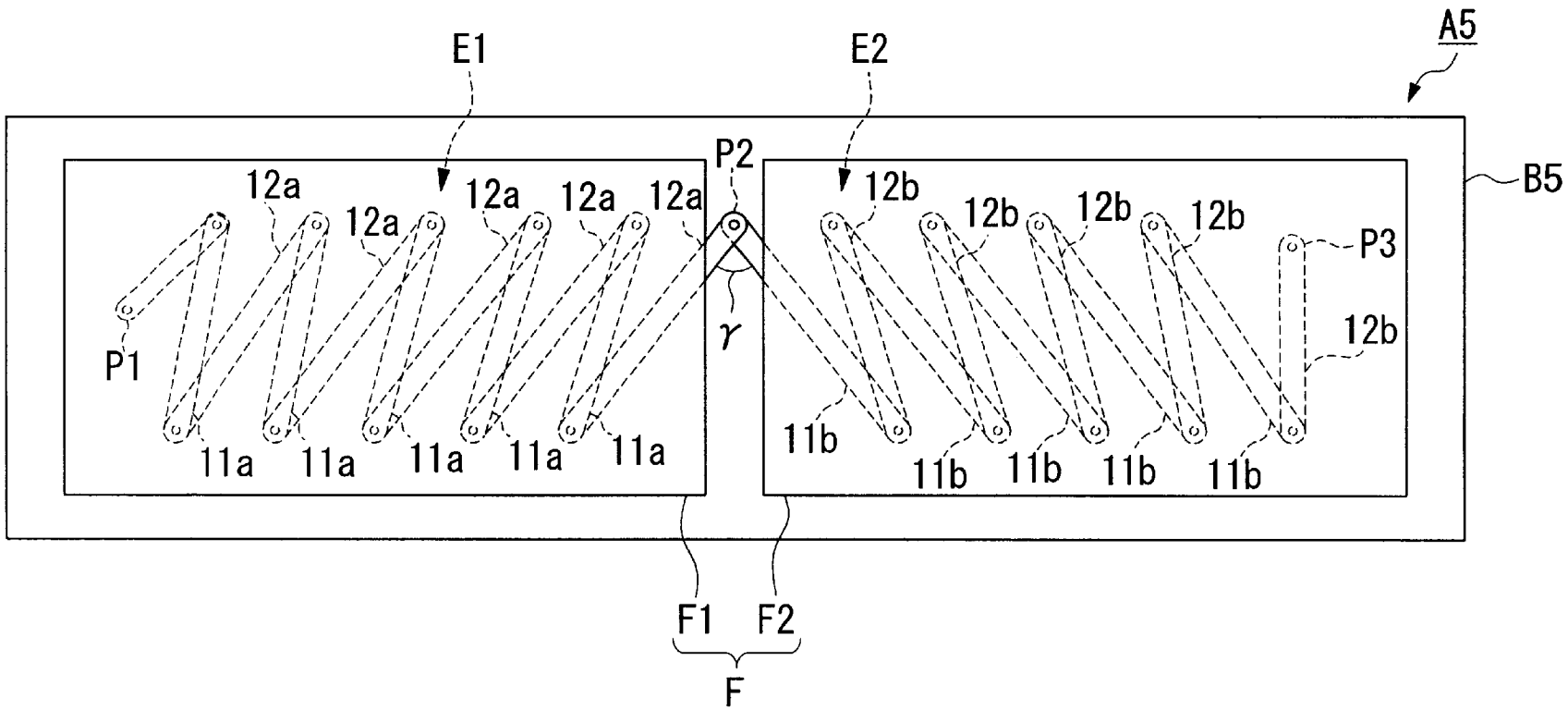
FIG. 13 is a top view of the example of the antenna in Embodiment 3 of the present invention.
Figure 14:
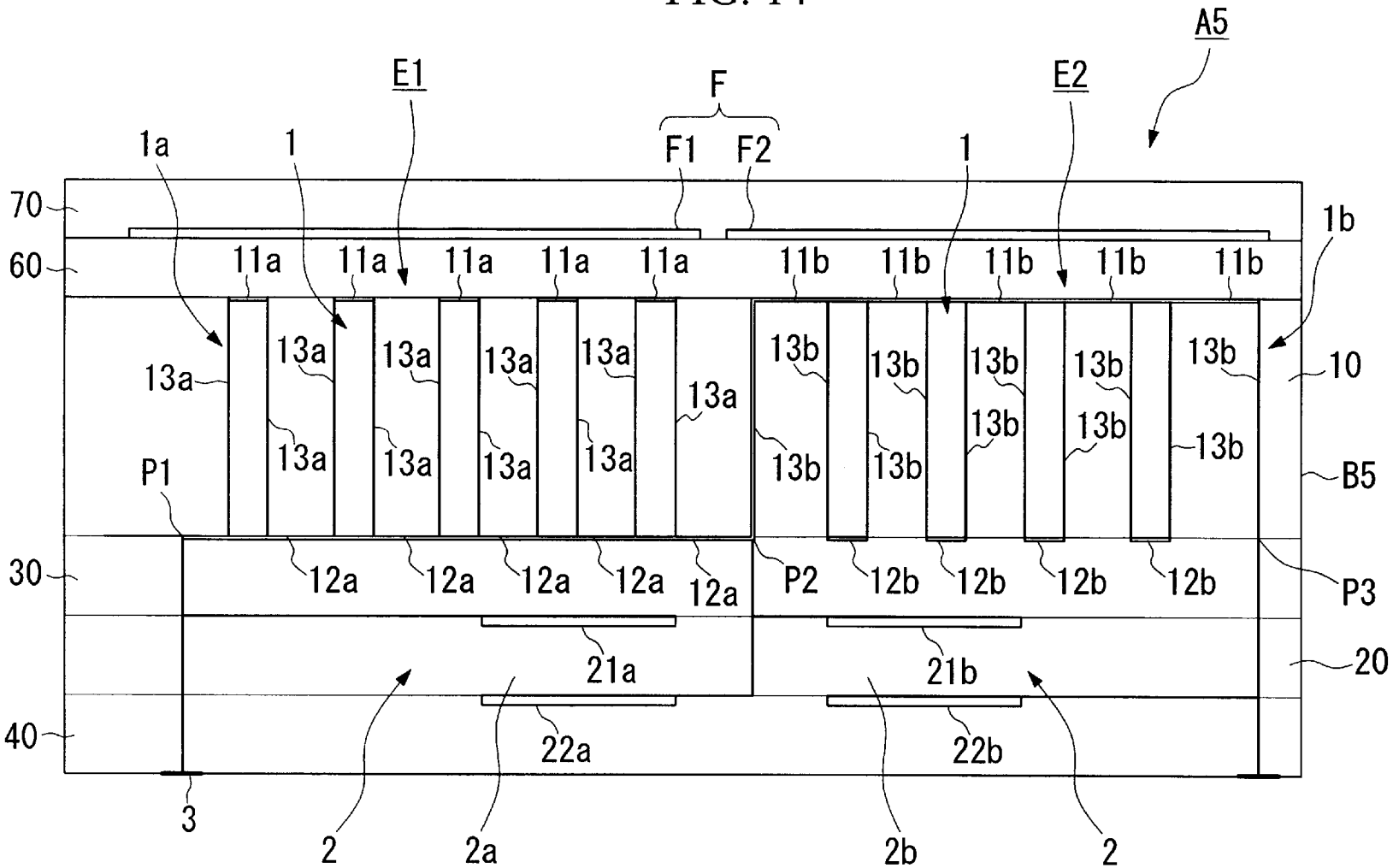
FIG. 14 is a schematic diagram showing the laminated structure of the antenna in Embodiment 3 of the present invention.

FIGS. 12 to 14 show Embodiment 3 of the antennas of the present invention. In these diagrams, those parts that correspond to those shown in FIGS. 1~8 are referred to by the same reference numbers, and their explanations are omitted.

Here, in this embodiment, the substrates plates 10, 20, 30 and 40 are insulation components comprised primarily of alumina, and adding a binder so as to produce a flexible green sheet of about 100 μm thickness, and sintering a number of such green sheets laminated each other to produce a insulation body.

Also, the conductor patterns 11*a*, 11*b*, 12*a*, 12*b* and conductor patterns 21*a*, 21*b*, 22*a*, 22*b*, serving as a conductor body formed on the substrate plates 10–40, are to be formed beforehand by screen printing a conductor comprised by a metallic material such as silver on the green sheets making the outermost layer of the substrate plates 10~40 by sintering. On the other hand, the coil conductor sections 13*a*, 13*b* that punch through conductor patterns imprinted on the substrate plates 10~40 in the lamination direction and provide electrical contacts are to be formed by filling the through-holes with a conductor such as a metal. And, by laminating a plurality of such green sheets to produce a unitized insulation compact, these conductor patterns and conductor sections become embedded inside the unitized insulation compact before sintering, and after the sintering operation, they form electrical circuits within the insulation body that function as the antenna.

As shown in FIG. 14, the antenna A5 is comprised by laminating a substrate plate 60 of sintered green sheets on one side of a substrate 10 having the inductance sections 1, and on a side opposite to a substrate plate 20 having the capacitance sections 2. On the substrate plate 60 is formed a plate insertion section F superimposing on the conductor patterns 11*a*, 11*b*, 12*a*, 12*b*, the conductor patterns 21*a*, 21*b*, 22*a*, 22*b* and the coil conductor sections 13*a*, 13*b* to provide a large planar pattern.

Viewing the antenna main body B5 from the lamination 10~40 side, the plate insertion section F is divided into a first plate insertion section F1 and a second plate insertion section F2 in the vicinity of a junction point P2 where the antenna elements E1, E2 are separated. That is, as shown in a top view in FIG. 13, the plate insertion section F is divided into the first plate insertion section Fl and the second plate insertion section F2, with a 1 mm separation therebetween, so as to separate the antenna elements E1, E2 in the longitudinal direction.

The plate insertion section F is made of the same material for making the conductor patterns 11*a*, 11*b*, 12*a*, 12*b*, conductor patterns 21*a*, 21*b*, 22*a*, 22*b* and the coil conductor sections 13*a*, 13*b*, which are imprinted by screen printing on the green sheet before sintering, and is embedded by laminating another green sheets making the substrate plate 70 after sintering so that it is finally clamped between the substrates 60 and 70. Accordingly, the plate insertion section F is disposed opposite to the capacitance sections 2 with the inductance sections 1 intervening between the two sections.

The antenna A5 shown in FIGS. 12 to 14 is constructed by forming internal electrical circuits comprised by laminating substrate plates 10~70 to form the unified antenna main body B5, to provide a chip-type antenna having a compact overall size and exhibiting superior handling characteristics, so that it can be readily incorporated as an electronic component into various radio signal transmitting and receiving devices by mounting on a printed circuit board and the like.

In the foregoing Embodiments 1~3, although the coils of the conductor patterns 12*a* of the antenna element E1 and the conductor pattern 11*b* of the antenna element E2 are coiled at different angles so as to form about 90 degrees at the junction point P2, but other angles may be used for the intersection angle. For example, when the conductor patterns 12 of the antenna element E1 and the conductor pattern 11 of the antenna element E2 intersect at the junction point P2 within a range of 45~135 degrees or preferably a range of 60~120 degree, mutual interference can be reduced effectively, and the gain can be increased significantly compared with the case of an antenna having a same angle of coil windings.

Figure 15:
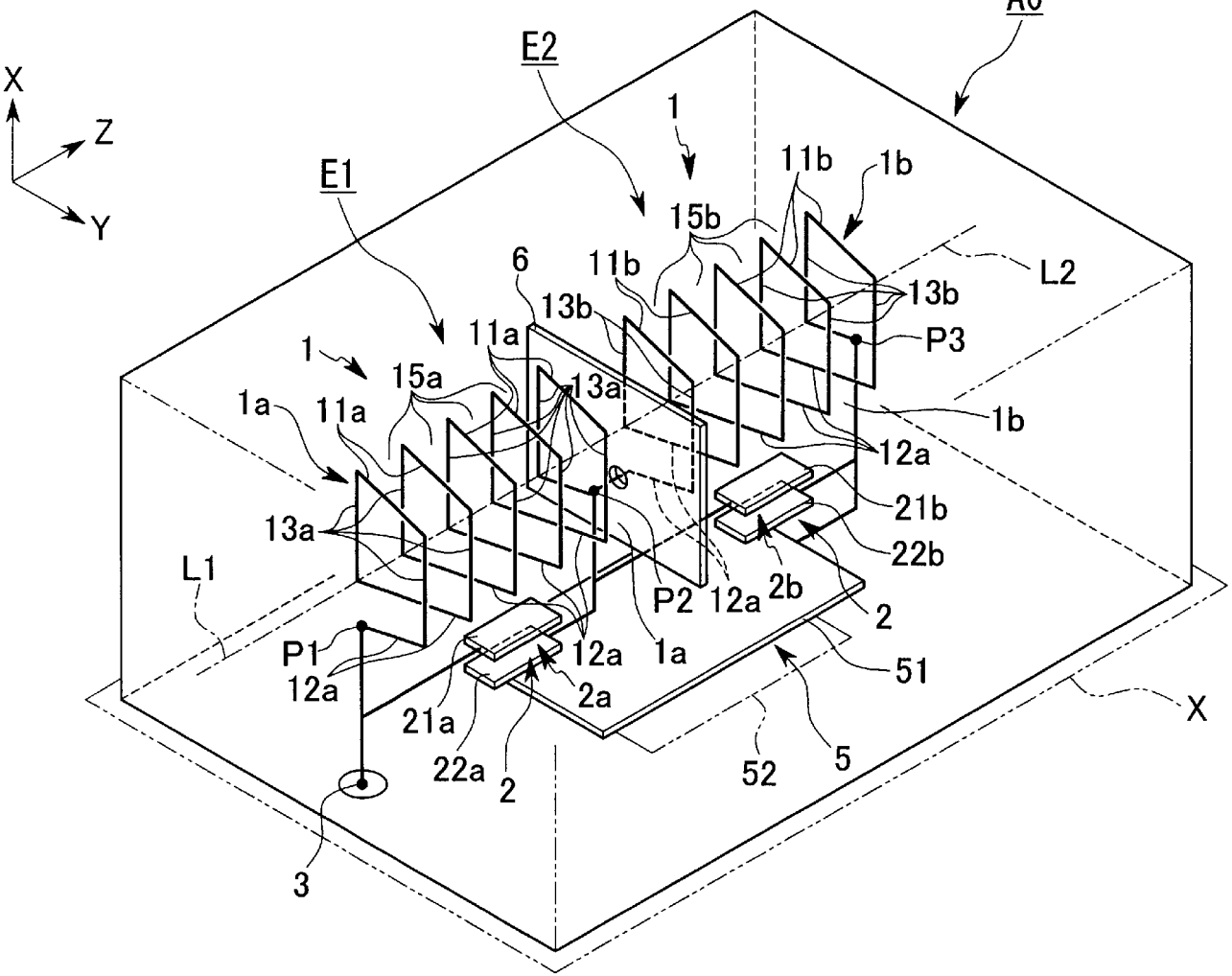
FIG. 15 is a perspective view of an example of an antenna in Embodiment 4 of the present invention.
Figure 16:
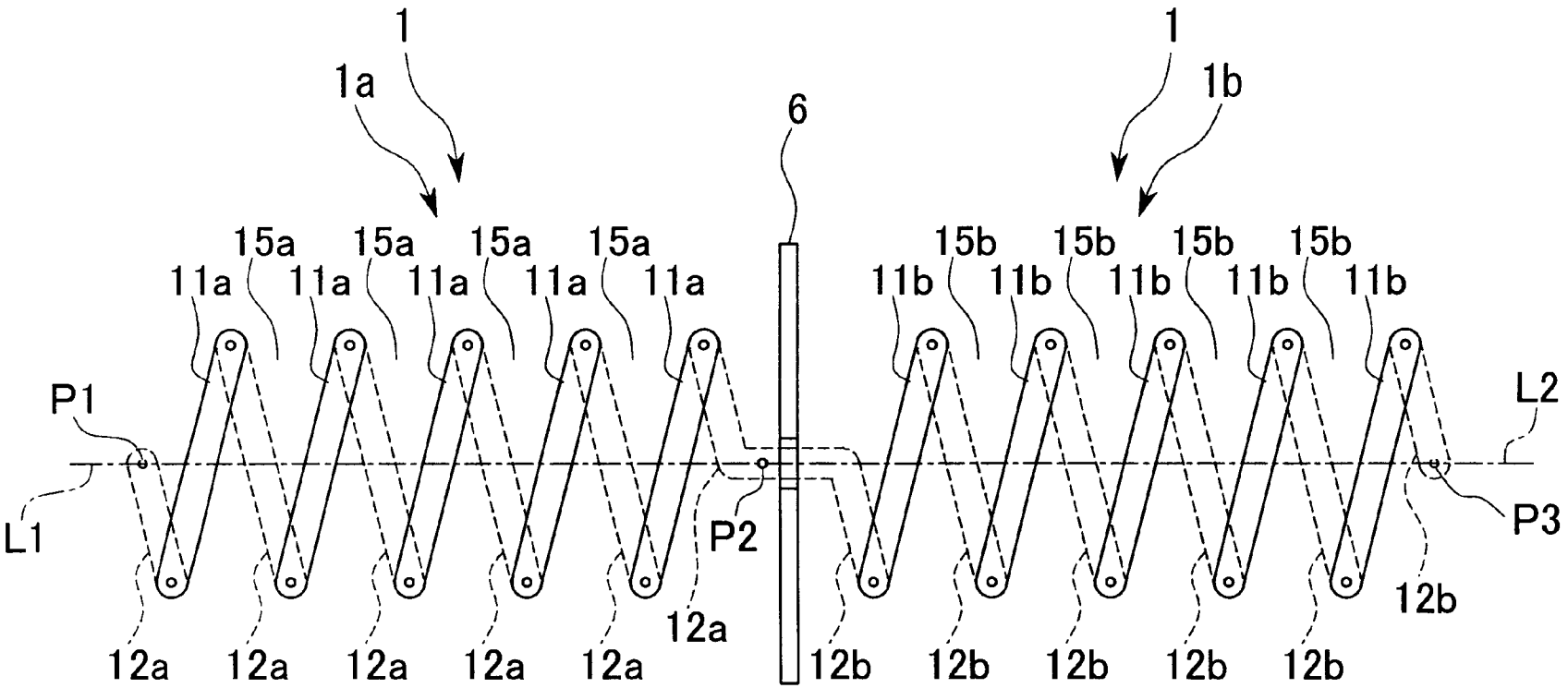
FIG. 16 is an nlarged top view of the coil section of the antenna shown in FIG. 15.

FIGS. 15 and 16 show the antenna in Embodiment 4 of the present invention. In these diagrams, the antenna A6 is comprised by two antenna elements E1, E2, which are connected electrically in series. The antenna elements E1, E2 are comprised so that each inductance section 1 and each capacitance section 2 are connected in parallel. Each induction section 1 has coil sections 1*a*, 1*b*, and a conductor section 6 between the coil sections 1*a*, 1*b*.

In other respects, the parts that are the same as those in FIGS. 1~8 are referred to by the same reference numbers, and their explanations are omitted.

FIG. 16 shows a top view of the antenna shown in FIG. 15, and shows an enlarged view of the coil sections 1*a*, 1*b* viewed perpendicular to the axes L1, L2. As shown in FIG. 15, the axis L1 of the coil section 1*a* and the axis L2 of the coil section 1*b* are aligned substantially in a straight line. The conductor patterns 11*a* comprising the coil section 1*a* and the conductor patterns 11*b* comprising the coil section 1*b* are all made parallel to each other, and the conductor patterns 12*a* comprising the coil section 1*a* and the conductor patterns 12*b* comprising the coil section 1*b* are all made parallel to each other. Further, in the top view, an average of the angles of intersection of axis L1 with the conductor patterns 11*a* and the conductor patterns 12*a* is 90 degrees, and an average of the angles of intersection of axis L2 with the conductor patterns 11*b* and the conductor patterns 12*b* is also 90 degrees.

In the antenna A6 shown in FIGS. 15 and 16, the conductor section 6 shields the electromagnetic waves of the antenna elements E1, E2, in particular, those produced from the coil sections 1*a*, 1*b* somewhat, so that the mutual interference between the adjacent antenna elements E1, E2 is reduced.

As described above, according to this embodiment, because the coil sections 1*a*, 1*b* of the antenna elements E1, E2 are substantially aligned collinealy and the conductor section 6 is disposed between the coil sections 1*a*, 1*b*, the mutual interference between the antenna elements E1, E2 is reduced and high gain is obtained.

Figure 17:
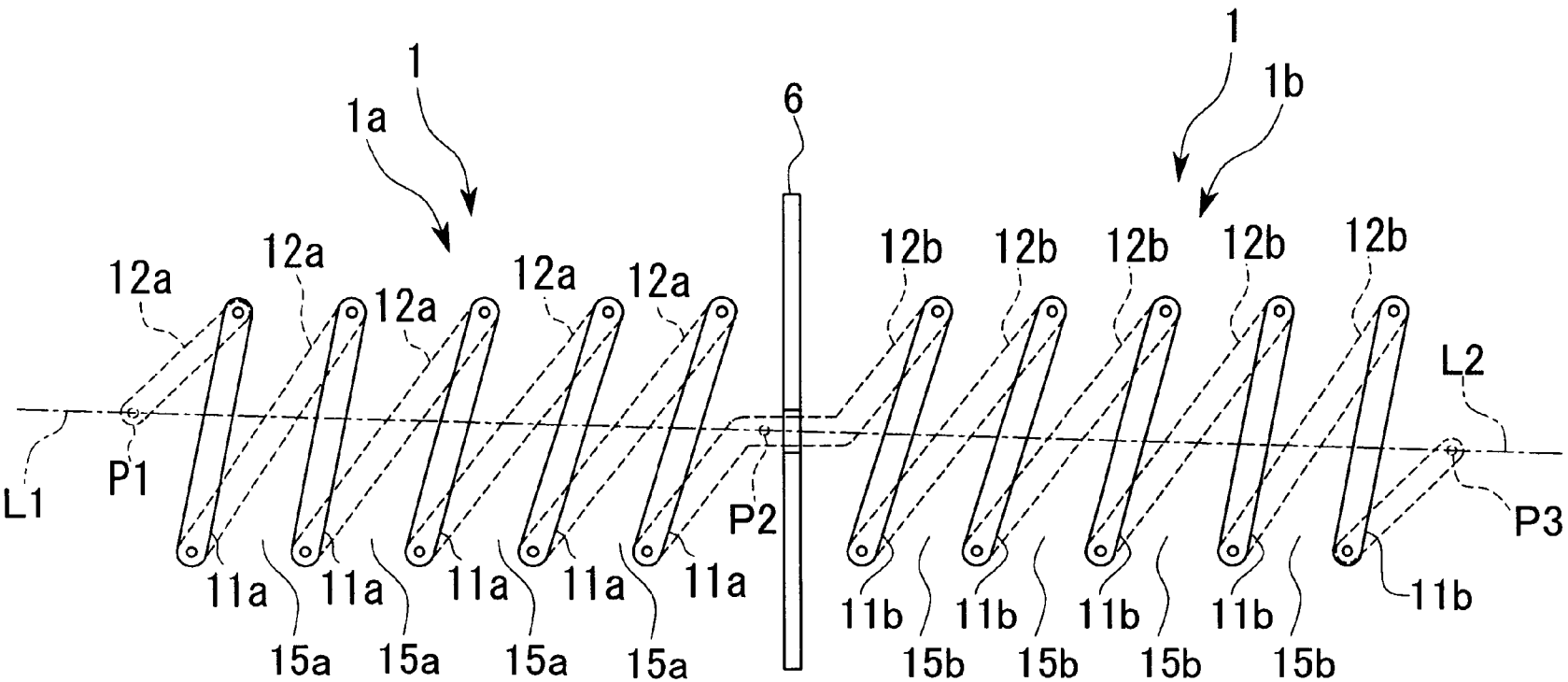
FIG. 17 is an enlarged top view of the coil section in another example of the antenna in Embodiment 4 of the present invention.

Here, in this embodiment, the antenna is constructed so that an average value of the angle of intersection of axes L1, L2 with the conductor of the coil sections 1*a*, 1*b* is 90 degrees, but as shown in FIG. 17, the angle of intersection may be an angle different than 90 degrees. According to such a structure, the area of opening at the terminal section of the coil sections 1*a*, 1*b* becomes larger so that the magnetic flux traversing the opening area is increased and the gain is increased. And, through such a structure that the conductor section 6 is disposed between the coil sections 1*a*, 1*b*, it is also possible to reduce the mutual interference between the antenna elements E1, E2 and to obtain high gain.

So far, in the structure of antennas of the embodiments presented to this point had the two antenna elements connected in series, but the series-connected antenna elements need not be limited to two, and other designs such as the one shown in FIG. 18 may adopted. The antenna A7 is comprised by three antenna elements E1, E2 and E3 connected in series electrically, in which each antenna element is comprised by an inductance section 1 and a capacitance section 2 connected in parallel, and a frequency adjusting capacitance section C3 is connected externally to the antenna A7. Further, more than four antenna elements may be connected in series to construct an antenna. However, there is a difficulty that, when there are more than three antenna elements, such an antenna is more susceptible to mutual interference so that the gain may be reduced.

Conversely, it is obvious that only one antenna element may be used to construct an antenna. Such a structure can function quite adequately as antenna. In case of using individual antenna elements, if the gain of each antenna element is assumed to be −5 $dB_i$, it is possible to increase the gain up to 3 $dB_i$ by connecting two such antenna elements in series as described in the above embodiments, so that the configuration proposed in this embodiment of connecting a plurality of antenna elements in series is quite effective in increasing the overall gain of an antenna.

It should be noted that the various design parameters of an antenna such as the material and size of each section of an antenna, especially, the dimensions of the condenser section, spacing of the conductor forming the inductance section, line and space ratio, number of conductor patterns, number of windings of the coil section are not limited to the values mentioned in the embodiments, such that for those antennas having different operating frequencies may have different parameter values within the allowable limit of the fabrication technology.

Furthermore, it is not necessary to construct the antenna by laminating substrate plates so long as the structure has in the antenna element is comprised by parallel-connected pair of inductance section and capacitance section so that the antenna may be constructed using conductor patterns and elements formed on a printed circuit board.

What is claimed is:

1. An antenna comprising not less than two antenna elements, wherein a plurality of antenna elements are connected in series, and each antenna element comprises an inductance section connected in parallel to a capacitance section.

2. An antenna according to claim 1, wherein each inductance section of the plurality of antenna elements comprises a coil section and the plurality of antenna elements connected is series are arranged in such a way that directions of magnetic fields generated by a current flowing in each coil section are intersecting with one another.

3. An antenna according to claim 1, wherein the plurality of antenna elements are connected in series to a frequency adjusting capacitance section.

4. An antenna according to claim 1, wherein each inductance section comprises a coil section, wherein the coil section comprises a conductor formed in a spiral shape circling a coil axis or an angular shape that can be approximated by a spiral circling a coil axis; and wherein the plurality of antenna elements are adjacent to each other and arranged so that respective axes of the coil sections of the plurality of antenna elements are aligned on a straight line.

5. An antenna according to claim 4, wherein at least a portion of the conductor that circles the coil axis is contained in a plane inclined at an angle to the coil axis.

6. antenna according to claim 5, wherein the planes containing the portions of the conductor of the coil sections, which are adjacent to each other, are inclined at different angles to the respective coil axes.

7. An antenna comprising not less than two antenna elements wherein a plurality of antenna elements are connected in series, and each antenna element comprises an inductance section connected in parallel to a capacitance section, wherein the plurality of antenna elements connected in series are arranged such that directions of magnetic fields generated by a current flowing in each inductance section are intersecting with one another.

8. An antenna according to claim 7, wherein each inductance section of the plurality of antenna elements comprises a coil section, wherein the coil section comprises a conductor formed in a spiral shape circling a coil axis or an angular shape that can be approximated by a spiral circling a coil axis; and wherein the plurality of antenna elements are adjacent to each other and arranged so that respective axes of the coil sections of the plurality of antenna elements are aligned on a straight line.

9. An antenna according to claim 8, wherein at least a portion of the conductor that circles the coil axis is contained in a plane inclined at an angle to the coil axis.

10. An antenna according to claim 9, wherein portions of the conductor that circle the coil axis are formed parallel to each other and are contained in planes inclined at an angle to the coil axis.

11. An antenna according to claim 10, wherein the planes containing the portions of the conductor of the coil sections, which are adjacent to each other, are inclined at different angles to the respective coil axes.

12. An antenna comprising;

not less than two antenna elements connected in series, an electrically isolated conductor section disposed between the two adjacent antenna elements, wherein each antenna element comprises an inductance section and a capacitance section connected electrically in parallel.

13. An antenna comprising not less than two antenna elements wherein a plurality of antenna elements are connected in series and each antenna element comprises an inductance section connected in parallel to a capacitance section, wherein the plurality of antenna elements connected in series are arranged such that directions of magnetic fields generated by a current flowing in each inductance section are intersecting with one another, each inductance section of the plurality of antenna elements comprises a coil section, the coil section comprises a conductor formed in a spiral shape circling a coil axis or an angular shape that can be approximated by a spiral circling a coil axis; and the plurality of antenna elements are adjacent to each other and arranged so that respective axes of the coil sections of the plurality of antenna elements are aligned on a straight line, the coil section is provided with a first conductor pattern formed on a first plane, a second conductor pattern formed on a second plane oppositely disposed to the first plane, and a coil conductor section for electrically connecting the first conductor pattern to the second conductor pattern; and the capacitance section has a condenser section having a third conductor pattern formed on a third plane and a fourth conductor pattern formed on a fourth plane oppositely disposed to the third plane;

such that the first plane, the second plane, the third plane and the fourth plane are disposed so as to face each other.

14. An antenna according to claim 13, wherein the first plane and the second plane are constituted by two opposing planes of a first substrate plate;

the third plane and the fourth planes are constituted by two opposing planes of a second substrate plate; and the first substrate plate and the second substrate plate are laminated with an intervening insulation layer into an integral unit.

15. An antenna according to claim 13, wherein the plurality of antenna elements and a first electrode formed on a fifth plane that opposes the first to fourth planes inclusively are contained in an antenna main body; and the antenna main body is mounted on a substrate plate having a second electrode so as to form a frequency adjusting capacitance section between the first electrode and the second electrode.

16. An antenna according to claim 15, wherein the first plane and the second plane are constituted by two opposing planes of a first substrate plate;

the third plane and the fourth planes are constituted by two opposing planes of a second substrate plate;

the fifth plane is constituted by a plane of a frequency adjusting substrate plate; and the antenna main body is formed by laminating the first substrate plate, the second substrate plate and the frequency adjusting substrate plate together with respective intervening insulation layers into an integral unit.

17. An antenna comprising not less than two antenna elements, wherein a plurality of antenna elements are connected in series, and each antenna element comprises an inductance section connected in parallel to a capacitance section, wherein the plurality of antenna elements are connected in series to a frequency adjusting capacitance section, and wherein the plurality of antenna elements are contained in an antenna main body, and the frequency adjusting capacitance section is provided as a separate body from the antenna main body such that the antenna main body and the frequency adjusting capacitance section comprise an antenna module.

18. An antenna comprising not less than two antenna elements, wherein a plurality of antenna elements are connected in series and each antenna element comprises an inductance section connected in parallel to a capacitance section, wherein the plurality of antenna elements and a first electrode connected electrically to the antenna elements are provided in an antenna main body; and the antenna main body is mounted on a substrate plate having a second electrode so as to form a frequency adjusting capacitance section between the first electrode and the second electrode.

* * * * *